US006171984B1

(12) United States Patent
Paulson et al.

(10) Patent No.: US 6,171,984 B1
(45) Date of Patent: Jan. 9, 2001

(54) FIBER GLASS BASED GEOSYNTHETIC MATERIAL

(75) Inventors: John N. Paulson, Atlanta, GA (US); Mikhail M. Girgis, Wexford, PA (US); Jeffrey A. Neubauer, Pittsburgh, PA (US); Narasimhan Raghupathi, Murrysville, PA (US)

(73) Assignee: PPG Industries Ohio, Inc., Cleveland, OH (US)

( * ) Notice: Under 35 U.S.C. 154(b), the term of this patent shall be extended for 0 days.

(21) Appl. No.: 08/984,283

(22) Filed: Dec. 3, 1997

(51) Int. Cl.[7] ..... D02G 3/24; D03D 1/00

(52) U.S. Cl. ..... 442/331; 442/366; 442/367; 442/381; 442/387; 442/388; 442/391; 405/15; 405/36; 405/107; 405/229

(58) Field of Search ..... 442/331, 366, 442/367, 381, 387, 388, 391; 405/15, 36, 107, 229

(56) References Cited

U.S. PATENT DOCUMENTS

| | | | |
|---|---|---|---|
| 2,881,732 | 4/1959 | Chystman | 118/33 |
| 2,929,738 | 3/1960 | Bateson et al. | 117/103 |
| 3,014,453 | 12/1961 | Bateson et al. | 118/58 |
| 3,515,623 | 6/1970 | Bates | 161/86 |
| 3,869,308 | 3/1975 | Graham | 117/126 GB |

(List continued on next page.)

FOREIGN PATENT DOCUMENTS

| | | |
|---|---|---|
| 1338347 | 5/1926 | (CA) . |
| 1217374 | 2/1987 | (CA) . |
| 1240873 | 8/1988 | (CA) . |
| 2753669 | 1/1978 | (DE) . |
| 240028 | 12/1993 | (DE) . |

(List continued on next page.)

OTHER PUBLICATIONS

"Impregnated Fiber Glass yarns for Reinforcing Industrial Coated Fabrics", *Journal of Coated Fabrics* (Apr. 1988).
"Geotextiles Needlepunched Fabric to Reinforce Steep Slopes", *High Performance Textiles* (May 1997).
K. Miyata, "Walls Reinforced with Fiber Reinforced Plastic Geogrids in Japan", vol. 3, Geosynthetic Int'l, No. 1 (1996).
"Strata Grid Case Study Byrd Park Lakefront Retaining Wall", Product Bulletin of Strata Systems, Inc. (1994).

(List continued on next page.)

*Primary Examiner*—Richard Weisberger
(74) *Attorney, Agent, or Firm*—Andrew C. Siminerio

(57) ABSTRACT

This invention relates to generally to geosynthetic materials which can be used for earthen reinforcement, and more particularly to a novel geosynthetic material exhibiting less strain under an initial tensile load then presently available geosynthetic materials. The novel geosynthetic material includes a first plurality of spaced-apart generally parallel fiber strands, a second plurality of spaced-apart generally parallel fiber strands positioned adjacent to and forming a plurality of intersections with at least a portion of the first plurality of strands, an organic tying member fixedly connecting portions of fiber strands of the first plurality of fiber strands with intersecting corresponding portions of the second plurality of fiber, and a bonding agent adhering predetermined regions of selected fiber strands of the first plurality of fiber strands with predetermined regions of selected fiber strands of the second plurality of fiber strands, wherein at least a portion of the fiber strands selected from the group consisting of the first plurality of fiber strands, the second plurality of fiber strands and combinations thereof comprise glass fibers. The present invention also relates to a novel geosynthetic composite including the novel geosynthetic material in combination with a second geosynthetic material, e.g. a geotextile fabric or geomembrane. The present invention also relates to a novel reinforced soil composite which includes a soil material in combination with the novel geosynthetic material of the present invention.

46 Claims, 7 Drawing Sheets

U.S. PATENT DOCUMENTS

| | | | |
|---|---|---|---|
| 3,956,565 | 5/1976 | Bolen et al. | 428/378 |
| 4,062,145 | 12/1977 | Gidge | 47/9 |
| 4,090,325 | 5/1978 | Mushin et al. | 47/9 |
| 4,374,798 | 2/1983 | Mercer | 264/288.8 |
| 4,390,647 | 6/1983 | Girgis | 523/212 |
| 4,421,439 | 12/1983 | ter Burg et al. | 405/258 |
| 4,472,086 | 9/1984 | Leach | 405/258 |
| 4,491,617 | 1/1985 | O'Connor et al. | 428/236 |
| 4,529,254 | 7/1985 | O'Connor et al. | 428/236 |
| 4,540,311 | 9/1985 | Leach | 404/72 |
| 4,610,568 | 9/1986 | Koerner | 405/19 |
| 4,619,854 | 10/1986 | Penttinen | 428/99 |
| 4,662,946 | 5/1987 | Mercer | 106/281 R |
| 4,663,231 | 5/1987 | Girgis et al. | 428/378 |
| 4,699,542 | 10/1987 | Shoesmith | 404/82 |
| 4,756,946 | 7/1988 | Mercer | 428/136 |
| 4,762,744 | 8/1988 | Wolceshyn et al. | 428/219 |
| 4,762,750 | 8/1988 | Girgis et al. | 428/378 |
| 4,762,751 | 8/1988 | Girgis et al. | 428/378 |
| 4,780,350 | 10/1988 | O'Connor et al. | 428/109 |
| 4,790,691 | 12/1988 | Freed | 405/263 |
| 4,795,678 | 1/1989 | Girgis | 428/391 |
| 4,837,387 | 6/1989 | van de Pol | 428/229 |
| 4,851,277 | 7/1989 | Valkenburg et al. | 428/167 |
| 4,867,614 | 9/1989 | Freed | 405/263 |
| 4,916,855 | 4/1990 | Halliday et al. | 47/88 |
| 4,957,390 | 9/1990 | Shoesmith | 404/18 |
| 4,960,349 | 10/1990 | Willibey et al. | 405/262 |
| 4,990,390 | 2/1991 | Kawasaki et al. | 428/113 |
| 5,007,766 | 4/1991 | Freed et al. | 405/24 |
| 5,091,247 | 2/1992 | Willibey et al. | 428/255 |
| 5,110,627 | 5/1992 | Shoesmith et al. | 427/208.4 |
| 5,156,495 | 10/1992 | Mercer | 405/262 |
| 5,187,004 | 2/1993 | Risseeuw | 428/229 |
| 5,197,202 | 3/1993 | Jensen | 34/23 |
| 5,226,255 | 7/1993 | Robertson | 47/56 |
| 5,246,306 | 9/1993 | Shoesmith et al. | 404/70 |
| 5,249,893 | 10/1993 | Romanek et al. | 405/258 |
| 5,344,470 | 9/1994 | Molnar et al. | 47/58 |
| 5,358,356 | 10/1994 | Romanek et al. | 405/16 |
| 5,393,559 | 2/1995 | Shoesmith et al. | 427/136 |
| 5,401,118 | 3/1995 | Kramer | 405/129 |
| 5,419,659 | 5/1995 | Mercer | 405/258 |
| 5,439,736 | 8/1995 | Wolceshyn | 428/109 |
| 5,447,389 | 9/1995 | Olson | 405/129 |
| 5,466,528 | 11/1995 | Girgis | 428/391 |
| 5,507,845 | 4/1996 | Molnar et al. | 47/1.01 |
| 5,552,207 | 9/1996 | Porter et al. | 428/109 |
| 5,555,674 | 9/1996 | Molnar et al. | 47/56 |
| 5,567,087 | 10/1996 | Theisen | 405/258 |
| 5,651,641 | 7/1997 | Stephens et al. | 405/258 |
| 5,669,796 | 9/1997 | Harford | 442/220 |
| B1 5,156,495 | 8/1994 | Mercer | 405/262 |

FOREIGN PATENT DOCUMENTS

| | | |
|---|---|---|
| 0199827A1 | 11/1986 | (EP) . |
| 0 464 803 | 1/1992 | (EP) . |
| 0318707B1 | 5/1993 | (EP) . |
| 670389 | 1/1994 | (EP) . |
| 2 572 426 | 5/1986 | (FR) . |
| 2713252 | 4/1995 | (FR) . |
| 3-69532 | 3/1991 | (JP) . |
| 5015602 | 1/1993 | (JP) . |
| 617402 | 1/1994 | (JP) . |
| 6-285942 | 10/1994 | (JP) . |

OTHER PUBLICATIONS

"Constructing a Reinforced Soil Wall with STRATGRID and Segmental Facing", Technical Bulletin GS 105 of Strata Systems, Inc. (1994).

"In Soil Characteristics and Interface Properties of STRATA GRID 9027", Technical Bulletin GS 101 of Strata Systems, Inc.

C. Fuller et al, "Constructing a Geogrid–Reinforced Rail Embankment", Geotechnical Fabrics Report (Jan./Feb. 1996).

"Design Strength Calculations for STRATGRID Products", Technical Bulletin GS 300 of Strata systems, Inc. (1994).

"A Better Way to Build", Technical Bulletin of Strata Systems, Inc. (1994).

Textile Terms and Definitions, The Textiles Institute (9th Ed. 1991), pp. 35–36.

"StrataGrid® 300",Technical Bulletin of Strata Systems, Inc.

"Product Data StratsGrid®", Technical Bulletin of Strata Systems, Inc. (Jun. 6, 1996).

StrataGrid® 100, Technical Bulletin of Strata Systems, Inc.

"High Performance Emulsions for Nonwovens", Technical Bulletin of B.F. Goodrich (1995).

"StrataGrid® 200, 500 & 600", Technical Bulletin, Strata Systems, Inc.

"HERCUFLEX® STRAND: The Applications are Endless", Technical Bulletin of PPG Industries, Inc. (about 1990).

M. Girgis, "Impregnated Fiber–Glass Yarn for High Strength Geosynthetic Reinforcement", American Chemical Society (1991).

I. Rubin, Handbook of Plastic Materials and Technology, (1990), pp. 955–1062, 1179–1215, 1225–1271.

Encyclopedia of Polymer Science and Technology, (1967), vol. 6, pp. 505–712, vol. 14, pp. 313–316, 347–350, 353–357; 396–397; vol. 2 (1965), pp. 703–706.

K. Loewenstein, The Manufacturing Technology of Glass Fibers, (3d, Ed. 1993), pp. 25, 30–44, 47–60, 115–122, 126–135, 237–289, 165–172, 219,222.

Kirk–Othmer, Encyclopedia of Chemical Technology, vol. 1 (1963), pp. 203–205, 259–297, 305–307; vol. 21 (2d Ed. 1970) pp. 56–69, 369–377, 379; vol. 7 (1965) pp. 676, 679–686, 693–698; vol. 17 (1968) pp. 543–544.

PN–3716–K and PN–3716–L1, Technical Data Sheets of H.B. Fuller Co. (Jul. 25, 1994).

"Building Better Nonwovens", Technical Bulletin of Rohm and Haas Specialty Industrial Polymers (1994).

Hawley's Condensed Chemical Dictionary (12th Ed 1993), pp. 157, 331, 435, 455, 461, 851–852, 1215–1216, 942, 288, 1075.

"VYCAR™ Polyvinyl Chloride Emulsions" Technical of B. F. Goodrich Co. (May 1994), pp. 2, 13–17.

"Textiles Polymers and Chemicals Product Selection Guide", Technical Bulletin of B. F. Goodrich Co. (May 1995), pp. 7–8.

"B. F. Goodrich Emulsion Polymer Selection Guide", Technical Bulletin of B. F.Goodrich (1994).

"Technical Data VYCAR™ 352", Technical Bulletin of B. F. Goodrich Co. (Aug. 1994).

"Technical Data VYCAR™ 580×83", Technical Bulletin of B. F. Goodrich Co. (Aug. 1995), pp. 7–8.

"Technical Data VYCAR™ 552", Technical Bulletin of B. F. Goodrich (Aug. 1994).

B. Das, Principles of Geotechnical Engineering, (3d Ed. 1994) p. 7–9.
"Geotextiles Knitted Biodegradable Geogrid", International Newsletters (1997) p. 11.
"A New Concept . . . In Soil Reinforcement Strata PEC", Technical Bulletin of Strata Systems, Inc. (1997).
D. Gray et al, "Behavior of Fabric–Versus Fiber–Reinforced Sand", Journal of Geotechnical Engr., vol. 112, No. 8 (Aug. 1986), pp. 804–821.
"Strata PEC Product Data", Technical Bulletin of Strata Systems, Inc.

FIBER GLASS BASED GEOSYNTHETIC MATERIAL

CROSS REFERENCE TO RELATED APPLICATIONS

The present application is related to U.S. patent application Ser. No. 08/984,353, now allowed, entitled "Coated Fiber Strands, Reinforced Composites And Geosynthetic Materials", filed even date herewith and incorporated herein by reference in its entirety.

FIELD OF THE INVENTION

This invention relates generally to novel geosynthetic materials which can be used in a broad variety of erosion control and earthen reinforcement applications, and more specifically to a novel reinforced soil composite which includes a soil material in combination with the geosynthetic material of the present invention.

BACKGROUND OF THE INVENTION

The phrase "geosynthetic material" is broadly used to refer to a large class of engineered products that are used in a variety of geostructural applications including soil stabilization, support for earthworks, erosion barriers and retaining walls, among others. The phrase "geosynthetic material" may refer to structures or to the basic components of structures. The phrase "geosynthetic materials" as used herein does not include materials employed in the construction of buildings or materials used as an interlayer in the construction of concrete and/or asphalt roadways or roadway patch materials, as these are not geostructures, i.e. earthen structures or structures used to control or reinforce earthen structures.

The applications where geosynthetic materials are often employed may be broadly classified into six major functions: reinforcement of soil; separation of soil layers; soil filtration; controlled drainage; erosion control; and providing moisture barriers in or about soil. Soil reinforcement refers generally and broadly to increasing tensile and/or shear strength of earth or particulate structures, such as in retaining wall structures, steep grades and other applications that compel tensile and/or shear strength enhancement of particulate substrate properties. Some of the types of geosynthetic materials that perform these functions include: 1) geotextiles (also known as "geotextile fabrics" or "geofabrics", which include interwoven, non-interwoven or nonwoven fabric-like materials generally for separation/reinforcement); 2) geogrids (sometimes considered a subclass of geotextiles and which include grid-like structures having relatively large grid openings therein, generally for soil reinforcement); 3) geomembranes (sheet-like materials having little or no permeability to moisture, generally for moisture barrier applications); 4) geosynthetic clay liners (liners often consisting of a layer of bentonite or other very low permeability material supported by geotextiles, geogrids or geomembranes generally for moisture barrier applications); 5) erosion control products (any number of fabric-like, grid-like or sheet-like materials used to restrain the movement of soil or other components of particulate substrates, whether by wind, water or otherwise); and 6) specialty geosynthetics (generally referring to geosynthetics not otherwise classified).

The presently available geosynthetic materials, particularly geotextiles and geogrids, are predominately formed from polymeric materials. For example, several polymeric geogrids are available from Strata Systems, Inc. of Cumming, Ga., as described in technical sales brochures entitled: *Strata Systems. Inc., A Better Way to Build; STRATAGRID* 100; *STRATAGRID* 200; *STRATAGRID* 300; *STRATAGRID* 400; *STRATAGRID* 500; *STRATAGRID* 600 and *STRATAGRID* 700. The Strata Systems, Inc. geogrids are manufactured from polyester yarns knitted by warp knit weft insertion into a grid-like structure having a uniform network of apertures and providing tensile reinforcement in one principal direction. A polymeric coating, (e.g. a polyvinyl chloride coating) provides additional mechanical as well as chemical and ultraviolet radiation degradation protection.

Also for example, U.S. Pat. No. 5,669,796 discloses a geogrid comprised of bicomponent fibers comprising a polyethylene terephthalate core within a sheath of a polyolefin and including carbon black for ultraviolet (UV) stabilization. The grid is a warp knit, weft inserted geogrid in which the fibers are knit into a fabric and heat bonded together. The bicomponent fibers are described as providing an improved resistance to creep. The grid is not topcoated with coatings such as polyvinyl chloride (PVC) topcoats. Avoiding the topcoating process is described therein as beneficial in reducing manufacturing costs and reducing potential environmental problems.

Also for example, U.S. Pat. Nos. 4,421,439, 4,837,387 and 5,187,004 describe a supporting fabric, primarily for supporting soil materials. The fabric is a tri-layered noncoplanar grid of synthetic warp and weft yarns having limited fabric elongation or, in the case of U.S. Pat. No. 5,187,004, an ability to support chemically aggressive materials, particularly soil materials. The warp yarns are described as being formed of polyester and polyethylene terephthalate. Other polymeric yarns are listed as acceptable alternatives. The references describe the weft yarns as being made of the same material as the warp yarns or of a different material. An example is given of the combination of polyester warp yarns with polypropylene weft yarns.

As a further example, U.S. Pat. Nos. 4,960,349 an 5,091,247 describe an interwoven geotextile grid. The grid is formed of a plurality of spaced apart polymeric pick yarn bundles interwoven with a plurality of spaced-apart polymeric warp yarn bundles. A plurality of pairs of leno yarns parallel to the warp yarns add additional strength to the fabric, as do polymeric locking yarns. The grid is coated with a suitable PVC or other plastic coating such as latex, urethane or polyethylene coatings.

An erosion control mat which includes a grid-like scrim having a web of unconsolidated fibers disposed thereon is disclosed in U.S. Patent Nos. 5,249,893 and 5,358,356. The scrim and web are described as being formed of polypropylene, polyester, nylon, rayon, polyethylene, cotton or combinations of any two or more thereof.

U.S. Pat. No. 4,472,086 discloses a fabric which includes a grid composed of a first group of synthetic threads arranged substantially transversely to a second group of synthetic threads, wherein the first and second groups of threads are bonded to each other by knit yarn stitch bonds. According to the reference, because the fabric does not include an adhesive found in many fabrics, the basic yarn elongation is the only factor affecting fabric elongation, so that fabric elongation is precisely controllable. At column 4, lines 10–12, the reference states that the preferred synthetic material is a polyester or polypropylene. The fabric of the reference is used as an intermediate between a cracked road surface and an asphalt patch to be placed over the crack, wherein the fabric operates to prevent reflective racks from reflecting from the cracked road surface and into and through the asphalt patch.

Additional examples of polymeric based geosynthetic materials may be found in U.S. Pat. Nos. 4,374,798, 4,610,568, 4,662,946, 4,756,946, 4,851,277, 5,156,495, 5,419,659, 5,567,087, and 5,651,641.

One important limitation common among polymerically based geosynthetic materials, particularly geogrids, is that such materials are subject to substantial strain. Strain refers to the elongation of the geosynthetic material under tensile load, generally normalized with respect to cross-sectional area. Depending upon the orientation of the tensile load with respect to the geosynthetic material, the strain may occur along the longitudinal, transverse or both directions of the geosynthetic material. Strain resulting in 5 to 30 percent or more elongation of polymeric geosynthetic material is not uncommon, even at tensile loads which are only about 20 to 50 percent of the short term ultimate strength of the polymeric geosynthetic material. Another limitation common among polymerically based geosynthetic materials, particularly geogrids, is that such materials are subject to creep. Creep refers to the elongation of the geosynthetic material under a sustained tensile load. Yet another drawback of many polymeric based geosynthetic materials is that they deteriorate when subjected to ultraviolet radiation, either limiting the durability of such materials or requiring additional coatings and the like to protect the geosynthetic materials from the adverse effects of the ultraviolet radiation. A still further drawback of many polymerically based geosynthetic materials is that the weight of such materials per unit area is substantial, particularly where the material has been designed to withstand substantial loads, making such materials challenging to transport and install.

Grid-like structures formed of materials other than polymerically based materials are known, but such structures are not commonly used as geosynthetic materials. For example, U.S. Pat. Nos. 4,699,542, 4,957,390, 5,110,627, 5,246,306, and 5,393,559 generally describe reinforcements for asphaltic pavings comprising a grid of continuous glass fibers stitched at intersections of the crosswise and lengthwise strands to hold the grid shape. The grid may be overcoated with an asphaltic or resin coating to impart a semi-rigid nature to the grid. The resins may be selected from asphalt, rubber, modified asphalt, unsaturated polyesters, vinyl ester, epoxy, polyacrylates, polyurethanes, polyolefins and phenolics. The grid is laid on top of an underlying paving and adhered to it and an asphaltic paving layer is then applied on top of the grid.

U.S. Pat. Nos. 4,491,617, 4,539,254, 4,762,744, 4,780,350, 5,439,726, disclose the use of similar grid-like structures in bituminous roofing membranes.

U.S. Pat. No. 5,552,207 discloses an open grid fabric for reinforcing wall systems such as stucco walls, where the grid is affixed to a supporting wall such as a foam insulation board, and is then overcoated with the stucco material. The open grid fabric improves impact resistance for durability. The grid is formed of first and second sets of substantially parallel rovings which are combined using certain knits, leno weaves or adhesive methods. The rovings are direct-sized with at least a silane sizing. Warp rovings and weft rovings are tied together in a knitting process by a tie yarn. Preferred warp rovings and weft rovings are fiberglass strands, but others such as nylon, aramid, polyolefin and polyester may be used in various combination. The tie yarn is described as typically a low weight polyester, however the tie yarn may be formed from other materials as listed at column 7, lines 43–48 of the reference. The rovings of the open grid fabric are further locked together by a polymeric resin, such as polyvinyl chloride, polyvinylidene chloride, styrene butadiene rubber, urethane, silicone, acrylic and styrene acrylate polymers.

An interwoven fabric of glass fiber or other inorganic warp and weft in which one or more selected warp ends are secured at each weft crossover by a bond of thermoplastic material, suitably nylon or polyester, is disclosed in U.S. Pat. No. 3,515,623. The thermoplastic material is melted to bond the crossovers together and prevent unraveling of the interwoven fabric. Such fabric is used, according to Bates et al., as internal reinforcing mesh in plied roofing papers or heavy duty wrapping papers and the like.

A technical bulletin of PPG Industries, Inc. of Pittsburgh, Pa., entitled "HERCUFLEX™ Strand: The Applications Are Endless", (about 1990), which is hereby incorporated by reference, suggests the use of HERCUFLEX™ fiberglass strand for geotextiles.

*Impregnated Fiber-Glass Yarn For High-Strength Geosynthetic Reinforcement,* Girgis, M., High-Tech Fibrous Materials, Chapter 22, pp. 337–350, American Chemical Society, Washington, D.C. (1991) describes the use of fiber-glass yarn for geosynthetic reinforcement. See also, *Impregnated Fiber Glass Yarns For Reinforcing Industrial Coated Fabric,* Girgis, M., J. of Coated Fabrics, Vol. 17, pp. 230–241 (April 1988) which describes the use of polymerically coated glass fibers in geotextile applications, among others.

*Walls Reinforced With Fiber Plastic Geogrids In Japan,* Miyata, K., Geosynthetics International Vol. 3, No. 1, pp. 1–11 (1996) describes geosynthetic reinforced soil retaining walls reinforced with high tensile strength and stiffness fiber reinforced plastic using a geogrid produced by impregnating high tensile strength continuous glass fiber bundles with vinyl-ester resin which was then molded to give the required geogrid geometry.

U.S. Pat. No. 4,990,390 describes a fiber grid reinforcement which includes a plurality of first fiber bundles and a plurality of second fiber bundles which perpendicularly intersect the plurality of first fiber bundles to form a grid. The fibers in each bundle and fiber bundles are bound to one another by a resin material. Column 3, lines 39–40 of the reference indicate that the fibers may be selected from glass fibers, and at lines 47–50 indicate that the resin can be a vinyl ester resin, unsaturated polyester resin, epoxy resin, phenol resin, among others.

U.S. Pat. No. 5,007,766 to Freed describes a shaped barrier for erosion control and sediment collection which includes a plurality of strands emanating outwardly from a foundation common to all of the strands, wherein the strands may be formed of glass, among other substances.

Chemically treated fibers, including glass fibers, and fabrics made thereof are described in U.S. Pat. Nos. 4,390,647, 4,663,231, 4,762,750, 4,762,751, and 4,795,678.

Despite the foregoing, most engineering fabrics or geotextiles in widespread use today are made from polymeric materials or fibers. It would be advantageous to provide a geosynthetic material which is not polymerically based and which does not suffer from substantial strain and/or creep, ultraviolet radiation sensitivity, weight per unit area, and/or the biological/chemical sensitivity common to some of the polymerically based geosynthetic materials presently available.

SUMMARY OF THE INVENTION

The present invention provides a geosynthetic material for reinforcing a soil material to form a reinforce soil composite, the geosynthetic material comprising a first plurality of spaced-apart generally parallel fiber strands, a second plurality of spaced-apart generally parallel fiber strands positioned adjacent to and forming a plurality of intersections with at least a portion of the first plurality of strands, a first tying member fixedly connecting portions of fiber strands of the first plurality of fiber strands with intersecting corresponding portions of the second plurality of fiber strands, a second tying member fixedly connecting at least two adjacent generally parallel spaced fiber strands of the first plurality of fiber strands, and a bonding agent adhering predetermined regions of selected fiber strands of the first plurality of fiber strands with predetermined regions of selected fiber strands of the second plurality of fiber strands. At least a portion of the fiber strands selected from the group consisting of the first plurality of fiber strands, the second plurality of fiber strands and combinations thereof comprise glass fibers.

Another aspect of the present invention is a geosynthetic material for reinforcing a soil material to form a reinforced soil composite, the geosynthetic material comprising a first plurality of spaced-apart generally parallel glass fiber strands, a second plurality of spaced-apart generally parallel glass fiber strands positioned adjacent to and forming a plurality of intersections with at least a portion of the first plurality of strands, a polyester tying member fixedly connecting portions of fiber strands of the first plurality of fiber strands with intersecting corresponding portions of the second plurality of fiber and fixedly connecting a plurality of adjacent generally parallel spaced fiber strands of the first plurality of fiber strands, and a bonding agent comprising polyvinyl chloride adhering predetermined regions of selected fiber strands of the first plurality of fiber strands with predetermined regions of selected fiber strands of the second plurality of fiber strands, wherein at least a portion of the fiber strands selected from the group consisting of the first plurality of fiber strands, the second plurality of fiber strands and combinations thereof comprise glass fibers.

Yet another aspect of the present invention is a geosynthetic composite comprising a first geosynthetic material comprising a first plurality of spaced-apart generally parallel fiber strands, a second plurality of spaced-apart generally parallel fiber strands positioned adjacent to and forming a plurality of intersections with at least a portion of the first plurality of strands, a first tying member fixedly connecting portions of fiber strands of the first plurality of fiber strands with intersecting corresponding portions of the second plurality of fiber strands, a second tying member fixedly connecting at least two adjacent generally parallel spaced fiber strands of the first plurality of fiber strands, and a bonding agent adhering predetermined regions of selected fiber strands of the first plurality of fiber strands with predetermined regions of selected fiber strands of the second plurality of fiber strands, wherein at least a portion of the fiber strands selected from the group consisting of the first plurality of fiber strands, the second plurality of fiber strands and combinations thereof comprise glass fibers and a second geosynthetic material. The second geosynthetic material is coextensive with at least a portion of the first geosynthetic material and is different from the first geosynthetic material.

Yet another aspect of the present invention is a reinforced soil composite comprising a soil material and a geosynthetic material for reinforcing the soil material to form a reinforced soil composite. The geosynthetic material comprises a first plurality of spaced-apart generally parallel fiber strands, a second plurality of spaced-apart generally parallel fiber strands positioned adjacent to and forming a plurality of intersections with at least a portion of the first plurality of strands, a first tying member fixedly connecting portions of fiber strands of the first plurality of fiber strands with intersecting corresponding portions of the second plurality of fiber strands, a second tying member fixedly connecting at least two adjacent generally parallel spaced fiber strands of the first plurality of fiber strands and a bonding agent adhering predetermined regions of selected fiber strands of the first plurality of fiber strands with predetermined regions of selected fiber strands of the second plurality of fiber strands, wherein at least a portion of the fiber strands selected from the group consisting of the first plurality of fiber strands, the second plurality of fiber strands and combinations thereof comprise glass fibers.

BRIEF DESCRIPTION OF THE DRAWINGS

The foregoing summary, as well as the following detailed description of the preferred embodiments, will be better understood when read in conjunction with the appended drawings. In the drawings.

DETAILED DESCRIPTION OF THE INVENTION

Figure 1:
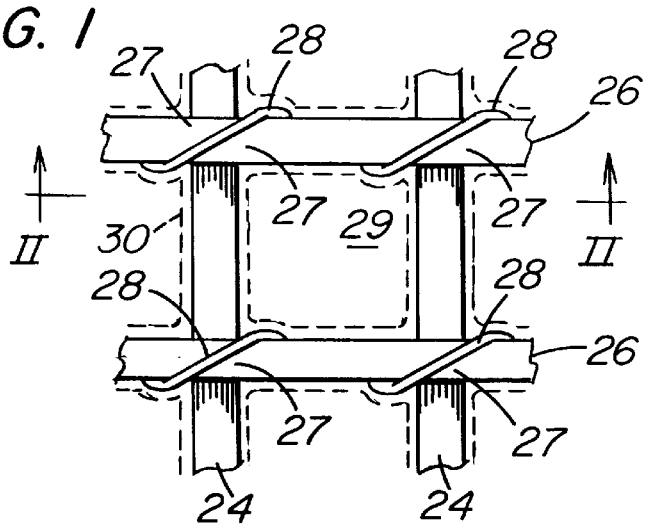
FIG. 1 is a top plan view of a geosynthetic material of the present invention.

The present invention is directed to a novel geosynthetic material having an improved resistance to the undesirable strain associated with the presently available geosynthetic materials. The novel geosynthetic material of the present invention has a higher strength to weight ratio than the geosynthetic materials presently available, exhibits improved resistance to chemical and/or biological attack, and has comparable resistance to installation damage to the geosynthetic materials presently available. The novel geosynthetic material of the present invention also has a specific gravity which is similar to that of saturated soil materials, which lessens the likelihood of floating or other movement of the geosynthetic materials when installed in saturated or supersaturated soil-reinforcing applications. It is also believed that the geosynthetic material of the present invention will exhibit comparable or superior resistance to creep to the presently available geosynthetic materials.

Several embodiments of the present invention are contemplated and are discussed below. It is an important aspect of the present invention that in each of the described embodiments at least a portion of the geosynthetic material is comprised of a material having a resistance to strain under an initial tensile load. In a preferred embodiment the material having a resistance to strain under an initial tensile load is an inorganic material. In a still more preferred embodiment of the present invention the material having a resistance to strain under an initial tensile load comprises glass fibers.

While the phrases "warp strand", "warp direction", "weft strand" and "weft direction" are used somewhat loosely in the art, the more precise use of such terms is in connection with fabrics comprising interwoven strands or filaments which strands or filaments are then properly termed warp strands or warp filaments and weft strands or weft filaments. While certain embodiments of the geosynthetic material of the present invention are directed to an interwoven fabric comprised of warp strands and weft strands, other embodiments include a first plurality of generally parallel strands intersected by a second plurality of generally parallel strands, wherein the strands are not interwoven. While such intersecting strands are not technically "warp" strands and "weft" strands as they are not interwoven, they will be referred to in the following description of the geosynthetic material of the present invention as "warp" strands and "weft" strands for the sake of simplicity of discussion.

More particularly, as used herein the phrase "warp strand" refers to strands that extend lengthwise in a knitting or weaving loom. "Warp direction" refers to a direction generally parallel to the longitudinal axis of the warp strand, also known as the machine direction (MD).

The phrase "weft strand" as used herein refers to strands running generally traverse to the warp strands, i.e., fill strands or woof. The term includes interwoven and non-interwoven strands unless otherwise clear from the context in which it is used. The phrase "weft direction" refers to a direction generally parallel to the longitudinal axis of the weft strands, also known as the cross machine direction (CMD).

Further, as one skilled in the art would understand, these defined terms are terms of convenience for discussion only, as the geosynthetic material of the present invention could as easily be constructed with those strands designated herein as the warp strands operating as weft strands, while those strands designated herein as the weft strands operate as the warp strands.

A basic embodiment of the present invention is now described, followed by a detailed discussion directed to each component of that basic embodiment. The discussion of each component also describes alternative embodiments of that component as deemed appropriate to the discussion of that particular component. Following the discussion of this basic embodiment of the present invention, alternative embodiments of the present invention are discussed. This discussion is followed by a discussion of several of the contemplated uses of the geosynthetic material of the present invention.

Figure 2:
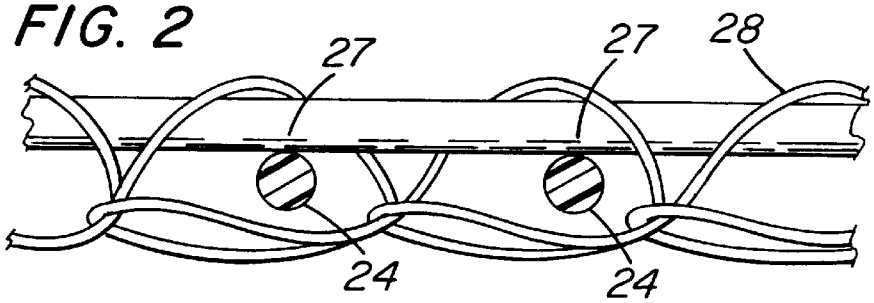
FIG. 2 is a cross section along the line II—II of FIG. 1.

Referring now to the drawings, wherein like reference numerals indicate like elements throughout, there is shown in FIGS. 1 and 2, one embodiment of the novel geosynthetic material of the present invention. The geosynthetic material 20 comprises a first plurality of spaced-apart generally parallel fiber strands 24, designated hereinafter as warp strands, which are preferably generally coplanar. A second plurality of spaced-apart generally parallel fiber strands 26, designated hereinafter the weft strands, are positioned adjacent to and form a plurality of intersections 27 with at least a portion of the warp strands 24. The weft strands 26 are also preferably generally coplanar. The intersecting warp and weft strands 24, 26 form a grid pattern having a plurality of grid openings 29 therein. As may be appreciated by those skilled in the art, the intersecting warp strands 24 and weft strands 26 need not intersect perpendicularly to one another. The intersecting angle may be any angle, although a 90° angle is preferred. Further, although the warp and weft strands 24, 26 are shown as not interwoven in FIG. 1, interwoven warp strands 24 and weft strands 26 are also contemplated as within the scope of the present invention as illustrated in FIG. 4, where warp strands 424 are interwoven with weft strands 426.

At least one tying member 28 positioned generally about at least a portion of the intersections 27 fixedly connects portions of the warp strands 24 with intersecting corresponding portions of the weft strands 26. A bonding agent 30 shown in phantom in FIG. 1, (but not shown in FIG. 2 for the sake of clarity), is adhered to predetermined region of at least a portion of the warp strands 24 and weft strand 26 to bond at least a portion of the warp and weft strands 24,26 to one another. The predetermined regions are preferably about at least a portion of the intersections 27 of the warp strands 24 and weft strands 26 so that the bonding agent 30 functions to adhere the intersecting portions of the warp strands 24 and weft strands 26 together.

The Warp and Weft Strands of the Present Invention

The fibers comprising the warp and/or weft strands 24, 26 can include fibers formed from materials selected from the group consisting of natural materials, polymeric materials, inorganic materials and combinations thereof.

Suitable natural fibers include those derived directly from animal, vegetable and mineral sources. Suitable natural inorganic fibers include polycrystalline fibers, such as ceramics including silicon carbide, and carbon or graphite. Non-limiting examples of suitable animal and vegetable-derived natural fibers include cotton, cellulose, natural rubber, flax, ramie, hemp, sisal and wool.

Suitable polymeric fibers can be formed from a fibrous or fiberizable material prepared from natural organic polymers, synthetic organic polymers or inorganic substances. Natural organic polymers include regenerated or derivative organic polymers. Synthetic polymers include polyamides, polyesters, acrylics, polyolefins, polyurethanes, vinyl polymers, derivatives and mixtures thereof.

Non-limiting examples of useful polyamide fibers include nylon fibers such as are commercially available from E. I. duPont de Nemours and Company of Wilmington, Del., polyhexamethylene adipamide, polyamide-imides and aramids such as KEVLAR™, which is commercially available from duPont.

Polyester fibers useful in the present invention include thermoplastic polyesters such as those formed from polyethylene terephthalate (for example DACRON™ which is commercially available from duPont and FORTREL™ which is commercially available from Hoechst Celanese Corp. of Summit, N.J.) and polybutylene terephthalate.

Fibers formed from acrylic polymers believed to be useful in the present invention include polyacrylonitriles having at least about 35% by weight acrylonitrile units, and preferably at least about 85% by weight, which can be copolymerized with other vinyl monomers such as vinyl acetate, vinyl chloride, styrene, vinylpyridine, acrylic esters or acrylamide. A non-limiting example of a suitable acrylic polymer fiber is ORLON™, which is commercially available from dupont.

Useful polyolefin fibers are generally composed of at least 85% by weight of ethylene, propylene, or other olefins. Fibers formed from vinyl polymers believed to be useful in the present invention can be formed from polyvinyl chloride, polyvinylidene chloride (such as SARAN™, which is commercially available from Dow Plastics of Midland, Mich.), polytetrafluoroethylene, and polyvinyl alcohol (such as VINYLON™, a polyvinyl alcohol fiber which has been crosslinked with formaldehyde).

Further examples of fiberizable materials believed to be useful in the present invention are fiberizable polyimides, polyether sulfones, polyphenyl sulfones; polyetherketones, polyphenylene oxides, polyphenylene sulfides, polyacetals, synthetic rubbers or spandex polyurethanes such as LYCRA™, which is available from duPont.

Non-glass fibers believed to be useful in the present invention include those discussed above, and methods for preparing and processing several such fibers are discussed at length in the *Encyclopedia of Polymer Science and Technology,* Vol. 6 (1967) at pages 505–712, which is hereby incorporated by reference.

Useful inorganic fibers include, but are not limited to glass fibers. Glass fibers can be formed from any type of fiberizable glass composition known to those skilled in the art, and include those prepared from fiberizable glass compositions such as "E-glass", "A-glass", "C-glass", "D-glass", "R-glass", "S-glass", and E-glass derivatives that are fluorine-free and/or boron-free. Preferred glass fibers are formed from E-glass. As used herein, the term "fiberizable" means a material capable of being formed into a generally continuous filament, fiber, strand or yarn. Such composition and methods of making glass filaments therefrom are well known to those skilled in the art and further discussion thereof not believed to be necessary in view of the present disclosure. If additional information is needed, such glass compositions and fiberization methods are disclosed in K. Loewenstein, "The Manufacturing Technology of Glass Fibres", (3d Ed. 1993) at pages 30–44, 47–60, 115–122 and 126–135, which are hereby incorporated by reference.

It is understood that blends or copolymers of any of the above materials and combinations of fibers formed from any of the above materials can be used in the present invention, if desired.

In a particularly preferred embodiment of the present invention, at least a portion of the warp strands 24, at least a portion of the weft strands 26, or both, comprise inorganic fibers, particularly glass fibers. Preferably at least a portion of the fibers of those strands expected to be subjected to an initial tensile load comprise a sufficient portion of glass fibers to significantly reduce elongation or strain over that obtained with presently available polymerically-based geosynthetic materials.

Several embodiments of glass fiber-containing strands with or without polymeric fiber-containing strands are contemplated as within the scope of the present invention. For example, in one embodiment, each of the warp strands and weft strands are composed entirely of glass fibers. In an alternative embodiment, a portion of either the warp strands, the weft strands, or both, are composed of strands composed entirely of glass fibers, while the remaining portion of the warp strands, weft strands, or both, are composed of strands composed entirely of a polymeric material to provide a combination of glass strands and polymeric strands in either the warp direction, the weft direction, or both. In yet another embodiment of the present invention, all of the strands along a direction expected to be subjected to either an initial or a sustained tensile load, or both, e.g. the warp strands in a warp direction, may be formed of strands composed entirely of one material, e.g. glass fibers, while the strands in a second direction not expected to be subjected to either an initial or a sustained tensile load (or both), e.g. the weft strands in a weft direction, are formed of strands composed entirely of a second material, e.g. a polymeric material.

In yet another embodiment of the present invention, one or more warp strands, weft strands, or both, may be formed from strands wherein each strand is comprised a combination of two or more materials, as for example a strand comprised of both polymeric fibers and non-polymeric fibers, as for example inorganic fibers, preferably glass fibers. The polymeric fibers and non-polymeric fibers may be present in equal or unequal proportions in such a strand. Additionally, the polymeric fibers and non-polymeric fibers may be evenly or unevenly dispersed throughout the strand.

Where the polymeric fibers and non-polymeric fibers are dispersed unevenly throughout the strand, either may form a core material surrounded by the other. In other words, for example, the non-polymeric, e.g. glass strands, may be grouped to form a core material with the polymeric strands disposed about the core material. In yet another embodiment of the present invention, a portion of the warp strands, weft strands, or both may comprise strands wherein each strand is formed of a core material, which core material may be formed from a combination of polymeric fibers and non-polymeric fibers e.g. glass fibers, or from a core material comprised of all of the same type of fibers, e.g. glass fibers, which core material is then overcoated with a polymeric coating. Combinations of all of the foregoing embodiments are also envisioned as within the scope of the present invention.

The presence of the glass fibers in sufficient proportions in those directions of the geosynthetic material of the present invention expected to be subjected to either a sustained or initial tensile load, or both, provides a resistance to either strain or creep, or both, for the geosynthetic material of the present invention while significantly decreasing the weight and cost of the geosynthetic material. The glass fibers also exhibit improved resistance to chemical attack, biological attack and degradation in the presence of ultraviolet radiation, and to the extent they are present in the geosynthetic material of the present invention, the geosynthetic material will exhibit improved resistance to such attack and degradation.

While all of the foregoing combinations of strand materials are envisioned as within the scope of the present invention, for ease of discussion, in the following discussion of the geosynthetic material of the present invention, the geosynthetic material will be discussed with reference to warp strands and weft strands comprised of glass fibers, unless otherwise clear from the context.

Preferably the fibers, particularly the glass fibers when used in accordance with the present invention, are sized with a sizing composition. As used herein, the terms "size", "sized" or "sizing" refer to the composition applied to the fibers immediately after formation of the fibers. The sizing composition may provide lubricating and/or cohesiveness to the fibers to facilitate subsequent manipulation of the fibers when processed to form the geosynthetic material of the present invention.

Suitable components for the sizing composition will now be discussed. Preferably the sizing composition is aqueous-based and can include film-formers such as thermosetting materials and thermoplastic materials; lubricants; coupling agents; waxes; emulsifiers and water as components, such as are discussed above. Non-limiting examples of suitable sizing compositions are disclosed in K. Loewenstein, *The Manufacturing Technology of Continuous Glass Fibres,* (3d Ed. 1993) at pages 237–289. The amounts of such components used in the sizing composition are similar to the amounts set forth above for the base coating composition and can be determined by a skilled artisan without undue experimentation.

A preferred sizing composition includes about 78 eight percent PLURACOL V-10 polyoxyalkylene polyol (commercially available from BASF Wyandotte of Michigan); about 8 weight percent EMERY 6717 partially amidated polyethylene imine lubricant (commercially available from Henkel Corporation of Kankakee, Ill.) and about 14 weight percent A-1108 aminosilane (commercially available from OSi Specialties, Inc. of Danbury Conn.).

Examples of suitable thermoplastic and thermosetting film-forming materials for use in the sizing composition include acrylic polymers, alkyds, polyepoxides, phenolics, polyamides, polyolefins, polyesters, polyurethanes, vinyl polymers and mixtures thereof, such as are discussed below.

The sizing composition can comprise one or more coupling agents such as organo silane coupling agents, transition metal coupling agents, amino-containing Werner coupling agents and mixtures thereof. Preferred functional organo silane coupling agents include amino silane coupling agents, such as A-1100 and A-1108, each of which are commercially available from OSi Specialties, Inc. of Tarrytown, N.Y.

The sizing composition can further comprise one or more organic acids in an amount sufficient to provide the sizing composition with a pH of about 4 to about 6. Suitable organic acids include mono- and polycarboxylic acids and/or anhydrides thereof, such as acetic, citric, formic, propionic, caproic, lactic, benzoic, pyruvic, oxalic, maleic, fumaric, acrylic, methacrylic acids and mixtures thereof, which are well known to those skilled in the art and are commercially available.

Preferably, at least a portion of the fibers are coated with a base layer of a base coating composition over the above described sizing. In an alternative embodiment, the base layer is applied directly to at least a portion of the surfaces of the fibers as a sizing.

The base coating composition, when applied as an impregnant to the fibers of the strand, particularly where the fibers include glass fibers, provides cohesion between the fibers of the strand, thereby reducing breakage of individual fibers within the strand and imparts flexibility to the strand. The base coating may also provide a lubricating quality to the outer surfaces(s) of the fibers/strands. The base coating may also operate to protect the surfaces of the fibers from abrasion during processing. The combination of cohesion, flexibility, abrasion resistance and lubrication permits easier manipulation of the fibers as they are processed into the geosynthetic material of the present invention.

Preferably the base coating composition is different from the sizing composition, i.e., the base coating composition: (1) contains at least one component which is chemically different from the components of the sizing composition; or (2) contains at least one component in an amount which is different from the amount of the same component contained in the sizing composition. For example, the base coating composition can contain an acrylic polymer and the sizing composition can contain a chemically different polyoxyalkylene polyol. In another example, the base coating composition and sizing composition can each contain the same chemical component but in different amounts.

In the preferred embodiment, the base layer is a secondary coating applied to individual glass fibers over at least a portion of a sublayer of the essentially dried residue of a sizing composition, i.e., the base layer impregnates the strand to coat at least a portion of the individual fibers.

The base coating composition is preferably aqueous-based and can include film-formers such as thermoplastic materials, lubricants, coupling agents, plasticizers, waxes and emulsifiers. Examples of suitable thermoplastic film-forming materials for use in the base coating composition include acrylic polymers, polyamides, polyolefins, polyesters, polyurethanes, vinyl polymers and mixtures thereof, to name a few. The film-forming materials can comprise about 50 to about 95 weight percent of the base coating composition.

Acrylic polymers are preferred for use as film-forming materials in the base coating composition to provide alkali resistance and reduce cost. Suitable acrylic polymer(s) can be homopolymers, copolymers or multipolymers and can be the addition polymerization products of one or more monomer components comprising one or more acrylic monomers, polymers and/or derivatives thereof (hereinafter "acrylic(s)"). Useful acrylic monomers for forming the acrylic polymer include acrylic acid, methacrylic acid, esters of acrylic acid and methacrylic acid, such as acrylates and methacrylates, acrylamides, acrylonitriles and derivatives and mixtures thereof. Useful acrylics can have hydroxy and/or epoxy functionality. An addition polymerizable monomer or polymer can be polymerized with the acrylic. Methods for polymerizing acrylic monomers with themselves and/or other addition polymerizable monomers and preformed polymers are well known to those skilled in the art of polymers and further discussion thereof is not believed to be necessary in view of the present disclosure. If additional information is needed, such acrylics and polymerization methods are disclosed in *Kirk-Othmer,* Vol. 1 (1963) at pages 203–205, 259–297 and 305–307, which are hereby incorporated by reference.

Preferably, the acrylic polymer is present in an emulsion including an emulsifying agent, suitable examples of which are discussed below. A curable acrylic polymer is preferably self-crosslinking, although external crosslinking agents can be included in the aqueous coating composition for crosslinking a curable acrylic polymer with itself or other components of the aqueous coating composition, as discussed below. The curable acrylic polymer can be cationic, anionic or nonionic, but preferably is anionic or nonionic.

Non-limiting examples of useful acrylic polymers include FULATEX® materials which are commercially available from H. B. Fuller Co. of St. Paul, Minn., such as FULATEX® PN-3716G, a butyl acrylate and styrene copolymer and FULATEX® PN-3716L1, a butyl acrylate, styrene and butyl methyl acrylate copolymer, FULATEX® PN-3716F, FULATEX® PN-3716H, FULATEX® PN-3716J and FULATEX® PN-3716K. See PN-3716-K and PN-3716-L1 Technical Data Sheets of H. B. Fuller Co. (Jul. 25, 1994), which are hereby incorporated by reference.

Other useful curable acrylic polymers include self-crosslinking acrylic emulsions such as RHOPLEX® E-32, E-693, HA-8, HA-12, HA-16, TR-407 and WL-81 emulsions commercially available from the Rohm & Haas Company. See "Building Better Nonwovens", a Technical Bulletin of Rohm and Haas Specialty Industrial Polymers, (1994), which is hereby incorporated by reference. Also useful are the CARBOSET acrylic polymers which are commercially available from B. F. Goodrich Co. of Toledo, Ohio.

Useful acrylic polymers include copolymers of acrylic monomers with vinyl compounds, such as n-methylolacrylamide vinyl acetate copolymers and VINOL® vinyl acetate products which are commercially available from Air Products and Chemicals, Inc. of Allentown, Pa., and ethylene acrylic acid copolymers such as MICHEM® PRIME 4990 or MICHEM® PRIME 4983HS, which are commercially available from Michelman Inc. of Cincinnati, Ohio.

As discussed above, other suitable thermoplastic film-forming materials for use in the base coating composition include polyolefins, such as polypropylene and polyethylene. Suitable elastomeric polyolefins useful in the present invention include diolefins, such as polyisoprene, polybutadiene, polychloroprenes (neoprenes), styrene-butadiene copolymers, acrylonitrile-butadiene copolymers and styrene-butadiene-vinylpyridine terpolymers.

Thermoplastic polyesters suitable as thermoplastic film-forming materials for use in the base coating composition include ethylene adipates and ethylene butylene adipates. Non-limiting examples of useful thermoplastic vinyl polymers include vinyl acetate copolymer emulsions and polyvinyl pyrrolidones.

Suitable thermoplastic polyurethanes are condensation products of a polyisocyanate material and a hydroxyl-containing material such as polyol and include, for example, Witcobond® W-290H which is commercially available from Witco Chemical Corp. of Chicago, Ill. and Ruco 2011L which is commercially available from Ruco Polymer Corp. of Hicksville, N.Y.

As mentioned above, the base coating composition can include one or more aqueous soluble, emulsifiable or dispersible wax materials, such as vegetable, animal, mineral, synthetic or petroleum waxes. Preferred waxes are petroleum waxes such as MICHEM® LUBE 296 microcrystalline wax, POLYMEKON® SPP-W microcrystalline wax and PETROLITE 75 microcrystalline wax which are commercially available from Michelman Inc. of Cincinnati, Ohio and the Petrolite Corporation of Tulsa, Okla., respectively. Generally, the amount of wax can be about 1 to about 10 weight percent of the base coating composition on a total solids basis.

Preferably, the base coating composition comprises one or more acrylic polymers and one or more wax materials, such as are discussed above. More preferably, the base coating composition comprises about 90 weight percent of RHOPLEX® E-32 acrylic polymer and about 10 weight percent of PETROLITE 75 microcrystalline wax on a total solids basis.

The base coating composition can include one or more emulsifying agents or surfactants for emulsifying components of the aqueous coating composition. Non-limiting examples of suitable emulsifying agents or surfactants include polyoxyalkylene block copolymers, ethoxylated alkyl phenols, polyoxyethylene octylphenyl glycol ethers, ethylene oxide derivatives of sorbitol esters and polyoxyethylated vegetable oils.

The base coating composition can also comprise one or more fiber lubricants such as amine salts of fatty acids, alkyl imidazoline derivatives, acid solubilized fatty acid amides, acid solubilized polyunsaturated fatty acid amides, condensates of a fatty acid and polyethylene imine and amide substituted polyethylene imines, such as EMERY® 6717, a partially amidated polyethylene imine commercially available from Henkel Corporation of Kankakee, Ill. and Alubraspin 226, which is commercially available from PPG Industries, Inc.

Examples of useful sized and secondarily coated strands include the HERCUFLEX™ fiber glass strands which are commercially available from PPG Industries, Inc. of Pittsburgh, Pa. See "HERCUFLEX™ Strand: The Applications Are Endless", a technical bulletin of PPG Industries (about 1990), which is hereby incorporated by reference. HERCUFLEX™ fiber glass strands can be sized and coated with secondary coating compositions such as are disclosed in U.S. Pat. Nos. 4,762,750 and 4,762,751.

The strands can be twisted by any conventional twisting technique known to those skilled in the art, for example by using twist frames. Generally, twist is imparted to the strand by feeding the strand to a bobbin rotating at a speed which would enable the strand to be wound onto the bobbin at a faster rate than the rate at which the strand is supplied to the bobbin. Generally, the strand is threaded through an eye located on a ring which traverses the length of the bobbin to impart twist to the strand, typically about 0.5 to about 3 turns per inch. Preferably, however, the strands are not twisted.

The fibers useful in accordance with the present invention have a nominal diameter ranging from about 0.0002 to 0.001 inches (5.0 to about 24.0 micrometers) (for glass fibers, corresponding to a fiber or filament designation of D through U), and preferably have a nominal filament diameter ranging from about 0.0004 to 0.0009 inches (10.0 to about 23.0 micrometers) (G through T). For further information regarding nominal filament diameters and designations of glass filaments, see Loewenstein at page 25, which is hereby incorporated by reference.

The number of fibers per strand can range from about 400 to about 8000, and preferably ranges from about 1500 to about 6500. The fibers can be grouped into a single bundle to form a strand, or into two or more bundles or substrands, which are then grouped together to form the strand. Preferably, each strand comprises one to five substrands, and more preferably one or two substrands.

The average diameter of the warp strands 24 and/or weft strands 26 preferably ranges from about 0.010 to about 0.120 inches (about 0.25 millimeters to about 3.05 millimeters), and more preferably about 0.020 to about 0.08 inches (about 0.51 millimeters to about 2.03 millimeters) after coating with sizing and/or base coating.

The HERCUFLEX™ strands described above in connection with the base coating discussion are particularly suitable for use in the present invention, and are commercially available in three configurations with about 1000 ("HF 1000"), 2000 ("HF 2000") and 4000 ("HF 4000") fibers per strand, with an average fiber diameter of about 0.0004 inches (11 microns). The average diameter of HF 1000, HF 2000 and HF 4000 strands respectively are about 0.020 inches (0.05 cm), 0.030 inches (0.08 cm) and 0.043 inches (0.11 cm).

In a particularly preferred embodiment of the present invention, at least a portion of the strands expected to be subjected to either an initial tensile load, a sustained tensile load, or both, e.g. the warp strands 24 in a preferred embodiment, are each comprised of two substrands of HF 1000 with about 1000 to 1600 filaments in each substrand. Each such strand thus comprises about 2000 to 3200 fibers or filaments and has a nominal diameter of about 0.030 inches (0.08 cm).

If the geosynthetic material of the of the present invention is comprised of equidistantly spaced warp strands 24 as illustrated in FIG. 1, the spacing between adjacent warp strands 24 is not limiting to the invention, but for example, typically can range from about 0.02 inches (0.05 cm) to about 0.10 inches (0.25 cm), and preferably about 0.025 inches (0.06 cm) to about 0.05 inches (0.13 cm). If individual weft strands 26 are spaced equidistantly as illustrated in FIG. 1, the spacing between adjacent weft strands 26 is not limiting to the invention, but for example, can range from about 0.02 inches (0.06 cm) to about 0.10 inches (0.25 cm), and preferably is about 0.025 inches (0.06 cm) to about 0.05 inches (0.13 cm). The grid opening dimensions provided thereby may range from about 0.25 inches (0.06 cm) by about 0.25 inches (0.06 cm) to about 10 inches (25.4 cm) by about 10 inches (25.4 cm). However, as may be appreciated by one skilled in the art, the opening dimensions may be varied significantly beyond the foregoing as required by the application in which the geosynthetic material is employed. Also, as may be appreciated by one skilled in the art, there is no requirement that the grid opening be square, and other opening shapes including, among others, trapezoidal or rectangular openings are contemplated as within the scope of the present invention.

It is also an important aspect of the present invention that at least a portion of the intersections 27 of the warp strands 24 and weft strands 26 are fixedly connected by a tying member which provides increased structural integrity to the geosynthetic material of the present invention. Several embodiments of the tying member are contemplated as within the scope of the present invention, as illustrated in FIGS. 3A, 3B and 3C.

Figure 3A:
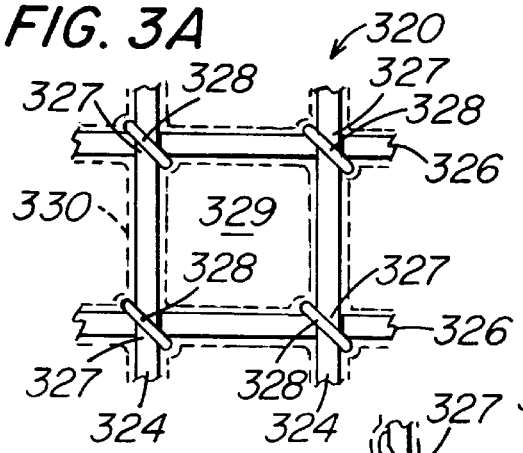
FIGS. 3A, 3B and 3C are top plan views of alternative embodiments of the geosynthetic material of the present invention.

Referring now to FIG. 3A, there is illustrated geosynthetic material 320, which includes a plurality of warp strands 324 overlying and intersecting a plurality of weft strands 326 to form a plurality of intersections 327 having openings 329 formed therein. Bonding agent 330 is shown in phantom over the warp strands 324, weft strands 326 and a plurality of individual tying members 328. Tying members 328 fixedly connect portions of individual warp strands 324 with intersecting corresponding portions of individual weft strands 326 at intersections 327.

Figure 3B:
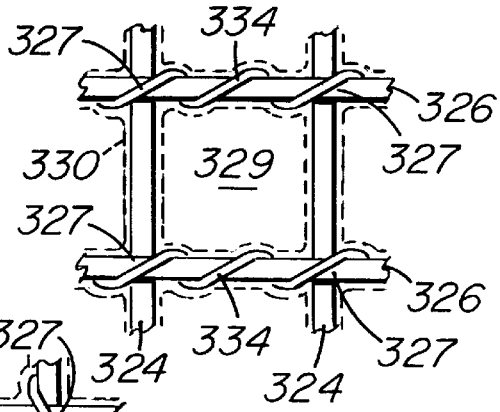

Referring now to FIG. 3B, alternatively or in combination with tying members 328, a plurality of alternative tying members 334 may be employed to affix two or more intersections 327 of two or more warp strands 324 with weft strand 326 along a single weft strand 326.

Figure 3C:
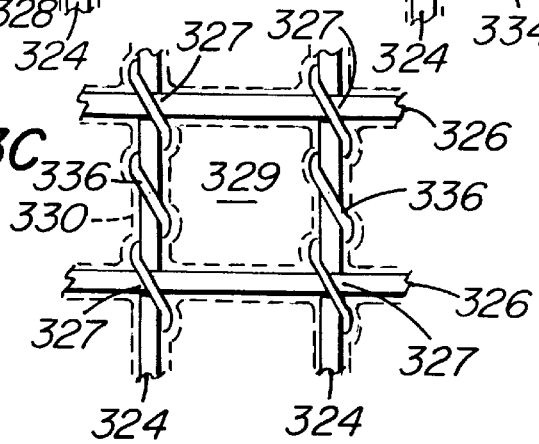

As shown in FIG. 3C, in still another embodiment which may be used alternatively or in combination with tying members 328 and 334, there are shown a plurality of tying members 336 which may be employed to affix two or more intersections 327 of two or more weft strands 326 with a warp strand 324 along a single warp strand 324.

The tying members 328, 334, and/or 336 are meant to be exemplary, and as may be appreciated by those skilled in the art, several other types of tying members may be employed.

The tying members may be formed from inorganic materials, organic materials, or combinations thereof.

Suitable inorganic materials include glass fibers, metallic fibers or combinations thereof, among others. Suitable organic materials include materials selected from the group consisting of natural materials, thermoplastic materials or combinations thereof.

Natural materials useful for forming the tying members include, for example, cotton, cellulose, natural rubber and wool. Non-limiting examples of suitable thermoplastic materials for forming the tying members include polyolefins, polyamides, thermoplastic polyurethanes, thermoplastic polyesters, acrylic polymers, vinyl polymers, acetals, polyaryl sulfones, polyether sulfones, polyimides, polyetherketones, polyphenylene oxides, polyphenylene sulfides and mixtures thereof.

Non-limiting examples of useful polyolefins include polyethylene, polypropylene, polyisoprene, polytetrafluoroethylene and neoprene.

Useful polyamides include nylons such as nylon 6, nylon 12, nylon 66, nylon 10 and nylon 12, such as are commercially available from E. I. duPont de Nemours and Company of Wilmington, Del. Other examples of useful polyamides include polyhexamethylene adipamide and aramids such as KEVLAR™, which is commercially available from DuPont.

Suitable thermoplastic polyurethanes include ESTANE™ and TEXIN™ polyurethanes which are commercially available from B. F. Goodrich and Bayer, respectively. Thermoplastic polyesters useful in the present invention include polyethylene terephthalate, such as DACRON™ which is commercially available from duPont and polybutylene terephthalate.

Acrylic polymers useful in the present invention include polyacrylates, polyacrylamides and polyacrylonitriles such as nitrile rubber and ORLON™, a copolymer which contains at least 85% acrylonitrile. Useful vinyl polymers are believed to include polyvinyl chloride, polyvinylidene chloride (saran), polyvinyl fluoride, polyvinylidene fluoridene, ethylene vinyl acetate copolymers, such as ELVAX™ which is commercially available from duPont, and polystyrenes.

Thermoplastic elastomeric materials useful for forming the tying members include styrene-butadiene rubbers, styrene-acrylontrile (SAN) copolymers such as LUSTRAN™, which is commercially available from Monsanto of St. Louis, Mo., styrene-butadiene-styrene (SBS) copolymers and acrylonitrile-butadiene-styrene (ABS) copolymers, such as CYCOLAC™ or BLENDEX™, which are commercially available from GE Plastics of Pittsfield, Mass.

It is understood that blends or copolymers of any of the above thermoplastic materials can be used to form the tying members. Also, combinations of fibers formed from any of the above organic and inorganic materials can be used to form the tying members.

Preferably, however, the tying members are essentially free of glass fibers such as are discussed above. As used herein, "essentially free of glass fibers" means that the tying members each respectively includes less than about 20 weight percent of glass fibers, and preferably less than about 5 weight percent. More preferably, the tying member is free of glass fibers.

The tying members may be a monofilament material or may be comprised of multifilament materials. Where the tying member comprises a monofilament material, it preferably has a Denier of about 350 to 5000, more preferably 500 to 2000. Where the tying member is comprised of a multifilament material, each of the individual filaments preferably have a Denier of about 3 to 10, and are bundled in groups of about 2 to about 250 to form a multifilament tying member having a Denier of about 5 to about 2500, preferably about 20 to about 750, more preferably about 100 to about 500 and still more preferably about 100 to about 200 Denier.

The tying members can be twisted, if desired, in a manner such as is discussed above. Preferably the tying members are texturized, i.e., they are comprised of multifilament strands wherein at least a portion of the filaments or fibers within each strand are bulked or slightly separated to increase the strand diameter and provide more surface area (for example by injecting pressurized air into the strand bundle).

In a preferred embodiment of the present invention, the tying member is comprised of a texturized polyester tying member having a Denier of about 450.

The bonding agent adheres predetermined regions of selected fiber strands of the warp with selected fiber strands of the weft. Referring now to FIG. 1, while the tying members described above fixedly connect portions of the warp strands 24 with intersecting corresponding portions of the weft strands 26, relative movement of warp strands 24 with respect to the weft strands 26 remains possible. Bonding agent 30 functions to adhere the intersecting portions of the warp strands 24 and weft strands 26 to each other to inhibit such relative movement, thereby providing a structurally stable grid-like geosynthetic material 20 as shown in FIG. 1.

Facing surfaces of the warp strands 24 and weft strands 26 may be in contact with one another with bonding agent 30 formed therearound, or facing surfaces of the warp strands 24 and the weft strands 26 may be slightly spaced from one another with bonding agent 30 filling the space between the facing surfaces of the warp strands 24 and the weft strands 26. The bonding agent 30 is preferably provided about at least a portion of the intersections 27 of the warp strands 24 and the weft strands 26 in the manner just described. Alternatively, the bonding agent 30 may be provided over the entire warp strand 24, weft strand 26, tying member 28 assembly to form the geosynthetic material 20.

The bonding agent 30 may be applied by any of several coating processes. A non-limiting example includes applying the bonding agent 30 by dipping tied warp and weft strands 24, 26 in a bath of bonding agent.

An additional non-limiting example includes spraying the bonding agent 30 over one or more surfaces of tied warp and weft strands 24, 26 by atomized sprays as are known in the art.

Yet another non-limiting example includes constructing one or more of the warp strands 24, weft strands 26 and/or tying members 28 of a bonding agent material, as opposed to providing it as a coating over these elements. As a non-limiting example, where the tying member 28 is formed of bonding agent material which is heat activated, (e.g. heat deformable), the warp strands 24 and weft strands 26 may be tied in the grid-like fashion shown in FIG. 1 with such a tying member 28, and the assembly may be subjected to sufficient heat as to cause the bonding agent-tying member 28 to melt to form the desired bonding between warp strands 26 and weft strands 26.

Yet another non-limiting example includes providing the bonding agent 30 as a coating over one or more warp strands 24, weft strands 24 or tying members 28. In this embodiment, preferably, the bonding agent 30 is applied as a principal layer over at least a portion of the base layer of the base coating composition described above. Preferably the principal layer of bonding agent 30 is a tertiary coating when applied to at least a portion of the warp strands 24 and/or weft strands 26, and is applied over those regions of these components about at least a portion of intersections 27. More preferably such a bonding agent principal layer is applied to the entire length of at least one of the warp strands 24 and weft strands 26. In an alternative embodiment, the principal layer of bonding agent 30 is a secondary coating. Preferably where the bonding agent 30 is a principal layer it is applied as an aqueous coating composition wherein the composition of the principal layer is different from the base coating composition, i.e., the aqueous coating composition (1) contains at least one component which is chemically different from the components of the base coating composition; or (2) contains at least one component in an amount which is different from the amount of the same component contained in the base coating composition. For example, the aqueous coating composition can contain an acrylonitrile-butadiene copolymer as an elastomeric material and the base coating composition can contain a chemically different elastomeric material such as a styrene-butadiene copolymer. In another example, the aqueous coating composition and base coating composition can each contain the same elastomeric material but in different amounts, as described above in connection with the base coating discussion.

The bonding agent 30 is applied in sufficient amounts so as to inhibit the relative motion of warp strands 24 and weft strands 26 to the extent necessary to withstand an expected sustained tensile load applied to the geosynthetic material. While not limited thereto, applying the bonding agent 30 in the range of about 20 to 100%, preferably 25 to 30% dry pickup weight (DPU) has been found to be acceptable for many applications in which the geosynthetic material is employed. DPU refers to the parts dry weight of bonding agent to 100 parts by weight of uncoated geosynthetic material which may be expressed in parts or percentages.

The bonding agent may be applied by any of the above described coating processes as a coating composition which is preferably dried to evaporate unbound moisture and cure any curable components of the bonding agent if present. The drying operation may include the application of heat. One skilled in the art would understand that the heating temperature and time can vary based upon such factors as the nature of the coating applied, weight of the coating applied, and the line speed of the coating process, among others. For many applications, for example, the bonding agent can be heated to a minimum temperature of at least about 250° F. (about 121° C.) to evaporate the unbound moisture and promote the curing reactions. The nature of the solvent in which the bonding agent is dissolved may affect the drying/curing temperature, as for example where the bonding agent is in an aqueous based system, the dying/curing may be within the ranges specified or may be considerably higher (e.g. in the range of 300° F. (148° C.) to about 350° F. (176° C.). Generally, a higher drying/curing temperature requires a shorter drying/curing time. The bonding agent is preferably applied as an aqueous coating, although one skilled in the art would understand that the bonding agent can be applied as a solvent-based coating (such as an organosol or plastisol).

The bonding agent preferably comprises one or more thermoplastic film-forming materials such as acrylic polymers, polyamides, polyolefins, polyesters, polyurethanes, vinyl polymers and mixtures thereof. Non-limiting examples of suitable thermoplastic film-forming materials are similar to those discussed above for the base coating composition. The film-forming materials can comprise about 50 to 100 weight percent of the bonding agent on a total solids basis.

Preferably, the bonding agent comprises a blend of (1) one or more halogenated vinyl polymers; and (2) one or more elastomeric polymers, the blend being essentially free of a monoolefinic material. As used herein, the terms "blend" or "polyblend" mean a uniform combination of (a) one or more halogenated vinyl polymers and (b) one or more elastomeric polymers. See *Hawley's* at page 157, which is hereby incorporated by reference.

The halogenated vinyl polymer can be a homopolymer, copolymer or multipolymer formed by the polymerization of one or more types of halogenated vinyl monomers or preformed copolymers of the halogenated vinyl monomers. Non-limiting examples of preferred halogenated vinyl monomers for forming the halogenated vinyl polymer include vinyl chloride, vinyl fluoride, vinylidene chloride, vinylidene fluoride and mixtures thereof. Vinyl monomers of other halogens of group VIIA of the Periodic Table, such as bromine, iodine, astatine and mixtures thereof, can also be used. As used herein, the term "mixture" means a heterogeneous association of substances which cannot be represented by a single chemical formula and which may or may not be uniformly dispersed and can usually be separated by mechanical means. See *Hawley's* at page 788–789, which are hereby incorporated by reference.

Examples of polymerization methods for forming the halogenated vinyl polymer(s) from the halogenated vinyl monomer(s) include bulk polymerization in the presence of a free radical initiator, emulsion polymerization, suspension polymerization and solution and precipitation polymerization. For information regarding methods for forming and polymerizing halogenated vinyl monomers, see *Hawley's Condensed Chemical Dictionary,* (12th Ed. 1993) at pages 1215–1216, *Encyclopedia of Polymer Science and Technology,* (1971) Volume 14 at pages 313–316 and Kirk-Othmer, *Encyclopedia of Chemical Technology,* (2d Ed. 1970) Volume 21 at pages 369–377, which are hereby incorporated by reference.

Examples of suitable halogenated vinyl polymers include polyvinyl chloride, polyvinyl fluoride, vinylidene chloride, vinylidene fluoride, mixtures thereof and copolymers thereof. Preferably, the halogenated vinyl polymer is polyvinyl chloride or a copolymer of polyvinyl chloride and vinylidene chloride.

Such polymers can be emulsified with any conventional emulsifier well known to those skilled in the art and such as are discussed below. Non-limiting examples of useful emulsified halogenated vinyl polymers include VYCAR™ 351, 352, 460X95, 575X43, 576, 577, 580X83, 580X158, 580X175, 590X4 vinyl chloride polymer and copolymer emulsions and VYCAR™ 650X18 and 660X14 vinylidene chloride copolymer emulsions, which are commercially available from B. F. Goodrich.

For example, VYCAR™ 352 vinyl chloride copolymer emulsion has a glass transition temperature of about 156.2° F. (69° C.), a specific gravity of 1.16, a pH of about 10.3 to about 10.5, a surface tension of about 39 dynes per centimeter, a Brookfield LVF viscosity of about 20 centipoise at 77° F. (25° C.) using Spindle No. 1 at 60 revolutions per minute (rpm), an average total solids of about 57 weight percent and includes an anionic emulsifier, according to the supplier.

Another example of a useful vinyl chloride copolymer emulsion is VYCAR™ 580X83, which is plasticized with di-isodecyl phthalate and has a glass transition temperature of about 62.6° F. (17° C.), a specific gravity of 1.14, a pH of about 10.0, a surface tension of about 35 dynes per centimeter, a Brookfield viscosity of about 30 centipoise at 77° F. (25° C.) using Spindle No. 2 at 60 rpm, an average total solids of about 56 weight percent and also includes an anionic emulsifier, according to the supplier.

For more information regarding useful commercially available halogenated vinyl polymers, see "VYCAR™ Polyvinyl Chloride Emulsions", a Technical Bulletin of B. F. Goodrich Company (May 1994) at pages 2 and 13–17; "Textile Polymers and Chemicals Product Selection Guide" A Technical Bulletin of B. F. Goodrich Co. (May 1995) at pages 7–8; "B. F. Goodrich Emulsion Polymer Selection Guide", a Technical Bulletin of B. F. Goodrich Co. (1994); "Technical Data VYCAR™ 352", a Technical Bulletin of B. F. Goodrich Co. (August 1994); and "Technical Data VYCAR™ 580X83", a Technical Bulletin of B. F. Goodrich (August 1994), which are hereby incorporated by reference.

Other materials which can be copolymerized with the halogenated vinyl polymer include vinyl esters such as vinyl acetate, acrylic esters such as methyl acrylate, ethyl acrylate and n-butyl acrylate, vinyl ethers such as cetyl vinyl ether or lauryl vinyl ether and maleic and fumaric esters. For more information, see *Encyclopedia of Polymer Science and Technology,* (1971) Volume 14 at pages 347–350 and 353–357, which are hereby incorporated by reference.

One or more plasticizers for the halogenated vinyl polymer can be included in the aqueous coating composition of the bonding agent. Non-limiting examples of suitable plasticizers include phthalates (such as di-isodecyl phthalate, a preferred plasticizer, di-2-ethyl hexyl phthalate, diisooctyl phthalate); phosphates (such as trixylyl phosphate and tricresyl phosphate); esters of aliphatic dibasic acids (adipates such as dioctyl adipate); polyesters; and trimellitates, such as trioctyl trimellitate. See Encyclopedia of Polymer Science and Technology, Volume 14 (1971) at pages 396–397, which are hereby incorporated by reference. The amount of plasticizer can be about 10 to about 40 weight percent of the aqueous coating composition on a total solids basis, and is more preferably about 20 to about 30 weight percent.

The aqueous coating composition of the bonding agent of the present invention also comprises one or more elastomeric polymers. As used herein, "elastomeric polymer" is a polymer which is capable of recovery from large deformations quickly and forcibly and has the ability to be stretched to at least twice its original length and to retract very rapidly to approximately its original length when released. See *Hawley's* at page 455 and *Kirk-Othmer,* Volume 7 (1965) at page 676, which are hereby incorporated by reference.

Suitable elastomeric polymers useful in the present invention for blending with the halogenated vinyl polymer include diolefins, such as polyisoprene, polybutadiene, polychloroprenes (neoprenes), styrene-butadiene copolymers, acrylonitrile-butadiene copolymers and styrene-butadiene-vinylpyridine terpolymers. Other elastomeric polymers useful in the present invention include fluoroelastomers, polysulfides, silicone rubbers, polyacrylates and polyurethanes.

Preferably, the elastomeric polymer is a diolefin such as an acrylonitrile-butadiene copolymer or nitrile rubber. Suitable nitrile rubbers generally contain about 50 to about 82% butadiene. An example of a suitable acrylonitrile-butadiene copolymer is HYCAR G-17, which is commercially available from B. F. Goodrich Chemical Co. of Cleveland, Ohio.

Polyisoprene is the main component of natural rubber. Suitable synthetic polyisoprene is commercially available from Shell Chemical Co. of Houston, Tex. Polybutadiene useful in the present invention generally has about 92 to about 97% cis-1,4-polybutadiene. Suitable chloroprenes (neoprenes) are emulsion polymers of 2-chloro-1,3-butadiene. Suitable styrene-butadiene copolymers generally contain about 71 to about 77% butadiene.

Suitable fluoroelastomers are rubbers containing fluorine, hydrogen and carbon, such as copolymers of vinylidene fluoride and chlorotrifluoroethylene (which are commercially available as Kel-F elastomers from Minnesota Mining and Manufacturing Co. (3M) of Minnesota) and copolymers of perfluoropropylene and vinylidene fluoride (which are commercially available from as VITON copolymers from E. I. duPont de Nemours & Co., Inc. of Wilmington, Del. and FLUOREL copolymers from 3M). Other useful fluoroelastomers include fluoroacrylates, fluoropolyesters, fluorinated silicones and fluorinated nitroso elastomers.

Useful polysulfides include NOVOPLAS polysulfides which are commercially available from ICI Americas, Inc. of Wilmington, Del.

Suitable polyacrylate elastomers are copolymers of alkyl acrylic acid esters, such as ethyl and butyl acrylates, and a crosslinking copolymer, such as acrylonitrile or a chlorinated vinyl derivative.

Suitable silicone rubbers are siloxane polymers composed of a central chain of alternating silicon and oxygen atoms with alkyl or aryl groups attached to the silicon atoms.

Suitable polyurethane elastomers can be formed by the condensation reaction of polyfunctional isocyanate-containing materials with linear polyesters or polyethers containing hydroxyl groups (polyols). Useful polyfunctional isocyanate-containing materials are difunctional isocyanates such as toluene diisocyanate, phenylene diisocyanate, dianisidine diisocyanate, diisocyanatodiphenyl methane, bis(p-phenyl isocyanate), bis(p-phenyl) methylene diisocyanate, bis(p-phenyl cyclohexyl) methylene diisocyanate, naphthalene diisocyanate, xylylene diisocyanate, tetramethylxylylene diisocyanate, cyclohexane diisocyanate, hexamethylene diisocyanate, isophorone diisocyanate and dicyclohexylmethane-4,4'diisocyanate. Useful linear polyesters containing hydroxyl groups can be formed by the reaction of ethylene or propylene glycol with adipic acid. Useful polyethers include polyoxy-1,4-butylene glycol, polyoxy-1,2-propylene glycol and polytetramethylene ether glycol.

A non-limiting example of a suitable polyurethane elastomer is ESTANE, which is commercially available from B. F. Goodrich.

Methods for forming suitable elastomeric polymers are well known to those skilled in the art and further discussion thereof is not believed to be necessary in view of the present disclosure. If more information is needed, see *Kirk-Othmer,* Volume 7 (1965) at pages 679–686 and 693–698 and Volume 17 (1968) at pages 543–544; *Encyclopedia of Polymer Science and Technology,* Volume 2 (1965) at pages 703–706 and *Hawley's* at page 942, which are hereby incorporated by reference.

The halogenated vinyl polymer and elastomeric polymer can be blended by conventional blending equipment such as a mixer. The ratio of halogenated vinyl polymer to elastomeric polymer in the blend can be about 5:95 to about 99:1 based upon the weight of total solids of the blend, is preferably about 50:50 to about 95:5 and is more preferably about 70:30 to about 90:10.

A non-limiting example of a useful commercially available blend of a halogenated vinyl polymer and an elastomeric polymer is VYCAR™ 552 vinyl chloride copolymer and acrylonitrile-butadiene copolymer polyblend emulsion which is commercially available from B. F. Goodrich and has a glass transition temperature of about 39.2° F. (4° C.), specific gravity of about 1.09, pH of about 10.3, a surface tension of about 36 dynes per centimeter, a Brookfield viscosity of about 17 centipoise at 77° F. (25° C.) using a Spindle No. 1 at 60 rpm, about 55 weight percent average total solids and which includes an anionic emulsifier. See "VYCAR™ Polyvinyl Chloride Emulsions" at page 15 and "Technical Data VYCAR™ 552", a Technical Bulletin of B. F. Goodrich (August 1994), which is hereby incorporated by reference.

The blend preferably has a glass transition temperature greater than 32° F. (0° C.) as measured using a Differential Scanning Calorimeter (DSC), for example a Perkin Elmer Series 7 Differential Scanning Calorimeter, using a temperature range of about −67° F. (−55° C.) to about 302° F. (150° C.) and a scanning rate of about 20° C. per minute.

As used herein, "essentially free of monoolefinic materials" means that the blend preferably contains less the about 5 weight percent and more preferably less than about 1 weight percent of a monoolefinic material (an unsaturated aliphatic hydrocarbon having one double bond. See *Hawley's* at pages 851–852, which are hereby incorporated by reference). Examples of such monoolefinic materials include alkenes, such as ethylene and propylene. Most preferably, the blend is free of a monoolefinic material.

Based upon the weight of the total solids of the aqueous coating composition, the blend of the halogenated vinyl polymer and the elastomeric polymer generally comprises about 50 to 100 weight percent of the aqueous coating composition, preferably comprises about 70 to 100 weight percent, and more preferably about 80 to 100 weight percent of the aqueous coating composition.

The bonding agent can further comprise one or more aqueous soluble, emulsifiable or dispersible wax materials, such as are discussed above, in an amount of about 1 to about 10 weight percent of the aqueous coating composition on a total solids basis. The bonding agent can also include one more emulsifying agents or surfactants (such as are discussed above) for emulsifying components of the aqueous coating composition, such as the halogenated vinyl polymer.

Anti-foaming materials and chlorine-removing catalysts can also be included in the bonding agent discussed above. Suitable anti-foaming materials are the SAG materials which are commercially available from OSi Specialties, Inc. Danbury, Conn. and MAZU DF-136 which is available from PPG Industries, Inc. A non-limiting example of a suitable catalyst for removing chlorine from the aqueous secondary coating composition is urea. The amount of anti-foaming materials and chlorine-removing catalysts can be about $1\times10^{-4}$ to about 5 weight percent of the bonding agent on a total solids basis.

Water (preferably deionized) is included in the aqueous coating composition of the bonding agent in an amount sufficient to facilitate application of a generally uniform coating upon the fibers of the strand. The weight percentage of solids of the aqueous coating composition generally can be about 5 to about 50 weight percent. Preferably, the weight percentage of solids is about 10 to about 30 weight percent and, more preferably, about 20 to about 30 weight percent. The aqueous coating composition can be prepared by any suitable method such as conventional mixing well known to those skilled in the art. Preferably the components discussed above are mixed together and the mixture is diluted with water to have the desired weight percent solids.

A preferred embodiment of the basic geosynthetic material of the present invention, as described above, comprises glass fibers in sufficient proportions in those directions of the geosynthetic material of the present invention expected to be subjected to either an initial tensile load, a sustained tensile load, or both, which provides among other benefits, a resistance to strain under an initial tensile load for the geosynthetic material of the present invention, while significantly decreasing the weight of the geosynthetic material. The proportion of glass fibers necessary will vary, as may be appreciated by those skilled in the art, with the precise construction selected from the above described alternative embodiments and with the desired or required performance characteristics required in light of the expected or predicted tensile load applied to the geosynthetic material and whether that tensile load may be expected along warp direction, a weft direction, or both. As described in more detail below, with an embodiment of the present invention comprising a sufficient proportion of glass fibers, it has been found that the strain under an initial tensile load may be reduced from the 15% to 30% commonly obtained with presently available polymeric geosynthetic materials to the range of about 2% to 4% for the novel geosynthetic material of the present invention geosynthetic materials having similar ultimate tensile strengths. This reduction in strain is substantial and represents an important advancement over the geosynthetic materials presently available. With some soils the peak strain experienced during loading is significantly less than 5% (sometimes 1–2%) with soil strength decreasing once this peak strain is exceeded. This is present, for example, with stiff clays and heavily compacted fills of both a clay and a sand consistency. A reinforced structure is most stable when strain compatibility between the soil and the reinforcing element is present. Strain compatibility is the condition when strength in the soil and strength in the reinforcing element are achieved at about the same strain level. The novel geosynthetic material of the present invention possesses high tensile strength at low strains, making it an ideal reinforcing element when low soil strains develop. It is a further advantage that the improved performance of the novel geosynthetic material of the present invention is obtained with a significant weight reduction over presently available polymeric geosynthetic materials for geosynthetic materials having similar ultimate tensile strengths. This advantage is obtained despite the fact that the density of most polymeric materials is less than that of glass fibers because the strength of glass fibers are typically much greater than that of polymeric fibers, permitting the use of far fewer glass fibers to obtain tensile strengths comparable to equivalent tensile strengths of polymerically based geosynthetic materials. The advantages associated with this weight reduction include among others, an improved ease of installation and handling and reduced shipping/handling expenses. Also as noted above, the glass fibers also exhibit improved resistance to chemical attack, biological attack and degradation in the presence of ultraviolet radiation, and to the extent they are present in the geosynthetic material of the present invention, the geosynthetic material will exhibit improved resistance to such attack and degradation. Another advantage is that the density of the geosynthetic material of the present invention is similar to that of saturated soil materials, which lessens the likelihood of movement of the geosynthetic materials when installed in saturated or supersaturated soil-reinforcing applications.

Having described the basic geosynthetic material of the present invention and some of the advantages attendant thereto, the discussion will now turn to alternative embodiments thereof as contemplated as within the scope of the present invention.

Figure 4A:
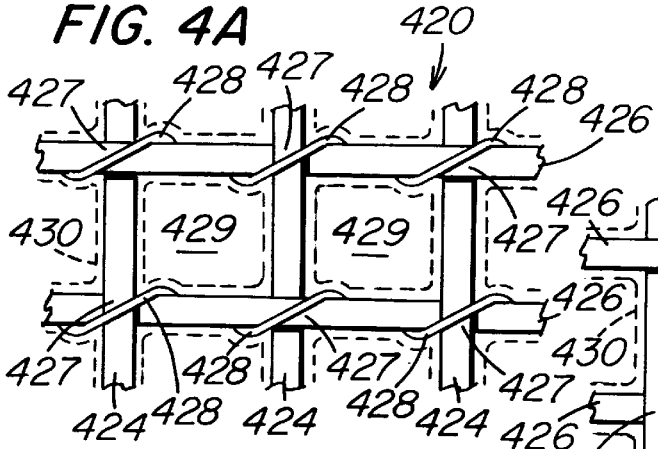
FIG. 4A is a top plan view of an alternative embodiment of the present invention illustrating an interwoven design with tying members.

Referring now to FIG. 4A there is illustrated an alternative embodiment of the present invention illustrating geosynthetic material 420 which is similar to the geosynthetic material 20 shown in FIG. 1, with the modification that the warp strands 424 and weft strands 426 are interwoven. The remaining elements illustrated in FIG. 4A, namely intersections 427, tying members 428, openings 429, and bonding agent 430 are all as described in connection with the discussion of similar elements in FIG. 1.

Figure 4B:
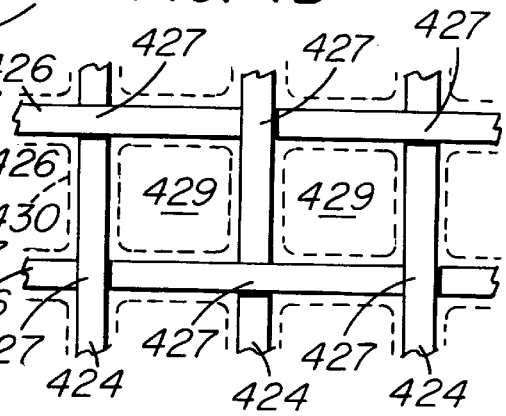
FIG. 4B is a top plan view of an alternative embodiment of the present invention illustrating an interwoven design without tying members.

Referring now to FIG. 4B, there is illustrated an alternative embodiment of the present invention which is similar to FIG. 4A, in which the warp strands 424 and weft strands 426 are interwoven. However, no tying members 428 are included in FIG. 4B. In this embodiment, the tying members are not required, particularly as the openings 429 are diminished in size and the weave becomes sufficiently tight. Similarly, while FIG. 4B is shown with bonding agent 430, in this embodiment bonding agent 430 is optional, and may be omitted if desired. In a preferred embodiment, the openings 429 are diminished, and the warp strands 424 and weft strands 426 are adjacent one another as in a typical interwoven fabric. The present invention is not limited to the weave pattern shown in FIG. 4B, but includes any weave pattern known in the art. The remaining elements, namely intersections 427 and bonding agent 430 (if present) are as described in connection with similar elements of FIG. 1.

Figure 5:
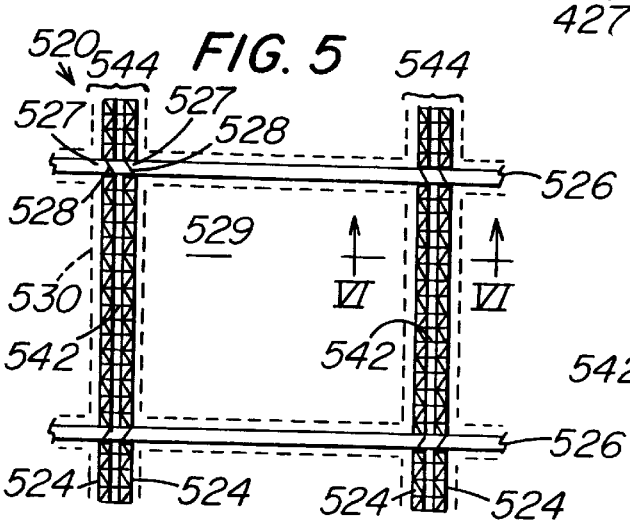
FIG. 5 is a top plan view of an alternative embodiment of the present invention illustrating a second tying member affixing adjacent warp strands together to form a warp rib.
Figure 6:
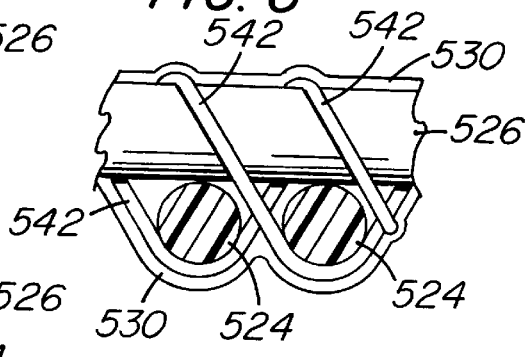
FIG. 6 is a cross section along the line VI—VI of FIG. 5.

Referring now to FIGS. 5 and 6 there is illustrated an alternative embodiment of the present invention illustrating the grouping of warp strands into ribs, which warp strands are affixed to one another by at least one second tying member. More particularly, there is shown geosynthetic material 520 which is comprised of warp strands 524 which are intersected by weft strands 526, forming intersections 527 having tying members 528, (hereinafter designated as "first tying member(s)") which are as described in connection with similar elements of FIG. 1. However, FIGS. 5 and 6 differ from FIG. 1 in that at least a pair of adjacent warp strands 524 are grouped together, spatially maintained and fixedly connected to one another, as for example, by a knitting process, by one or more second tying members 542 to form ribs 544. In this embodiment, the warp strands may also be referred to as "ends", thus the embodiment illustrated in FIG. 5 illustrated two "ribs" 544, each comprised of two "ends" 524. In a preferred embodiment of the invention at least one of the first tying members 528 and at least one of the second tying members 542 are adjacent portions of a single tying member. That is to say that a single tying member may be employed to fixedly connect a plurality of adjacent warp strands 524 together to form rib 544, while also fixedly connecting weft strands 526 to warp strands 524 at the intersections 527 of each.

While the second tying member 542 may be employed to affix adjacent facing surfaces of warp strands 524 in contact with each other, it has been found that providing at least a slight separation between adjacent warp strands 524 is preferred where the second tying member 542 extends along a substantial portion of the warp strands 524. It is preferred because it has been found that when bonding agent 530 is provided over the slightly separated warp strands 524 and second tying member 542, the geosynthetic material 520 has an improved structural stability over an embodiment where facing surfaces of the warp strands 524 are in contact with one another. The cross-section illustrated in FIG. 6 which is taken along the line VI—VI of FIG. 5, illustrates the bonding agent 530 and tying member 528.

Preferably, the ribs 544 comprise about two to about ten ends or warp strands 524 per rib 544, and more preferably about three to eight ends 524 per rib 544. One skilled in the art would understand that the grouping of the strands into ribs, the spacing between the ends within a rib and between ribs and weft strands can vary based upon such factors as the type of soil and location to be reinforced, the physical characteristics of the individual strands and the desired long term design tensile strength. However, by way of a non-limiting example, the spacing between adjacent warp strands 524 within the rib 544 can range from about 0.002 to about 0.10 inches (0.005 cm to 0.254 cm) and the distance between adjacent ribs 544 can range from about 0.25 inches to about 5 inches (0.64 cm to 12.7 cm), and preferably is about 0.75 inches to about 1.5 inches (1.9 cm to 3.8 cm). The spacing between the warp strands 526 need not be equidistant.

Similarly, the spacing between weft strands 526 need not be equidistant. By way of non-limiting example, the spacing between the weft strands 526 may range from about 0.02 inches to about 5 inches (0.05 cm to 12.7 cm), providing an opening 529 having dimensions of about 0.02 to about 5 inches (0.05 cm to 12.7 cm). However, as may be appreciated by one skilled in the art, the opening 529 dimensions may be varied significantly beyond the foregoing as required by the application in which the geosynthetic material is employed. Also, as may be appreciated by one skilled in the art, there is no requirement that the grid opening be square, and other opening shapes including, among others, trapezoidal or rectangular openings are contemplated as within the scope of the present invention.

The adjacent warp strands 524 may be affixed to each other by second tying member 542 where second tying member 542 is applied in a knitting operation utilizing a conventional knit-stitching machine. Non-limiting examples include a knitting machine such as is available from Liba Maschinenfabrik Gmbh of Naila, Germany under the model designation COPCENTRA HS-2/ST or knitting machines available from Mayer Textilmaschinenfabrik Gmbh of Germany. In a preferred embodiment where second tying member 542 and first tying member 528 are adjacent portions of the same tying member, the geosynthetic material 520 may be formed by a warp knit weft insertion weaving process where the weft strands 526 are inserted in the tying member as the tying member is knit along the warp strands 524 in order to knit both the adjacent warp strands 524 to one another and to knit the weft strands 526 to warp strands 524. Any type of stitching or knitting arrangement may be provided for the tying members such as chain loops, tricot loops or the like.

The second tying member 542 may be comprised of the same materials, dimensions etc., as described in connection with the first tying member 28 as discussed above in connection with FIG. 1. Preferably the second tying member 542 and the first tying member 528 are adjacent portions of the same tying member, which is applied as a warp knit, weft insertion weaving utilizing a tricot type stitch, where the tying member is a texturized polyester fiber strand having a Denier of about 20 to about 750, more preferably about 450.

While the geosynthetic material 520 of FIGS. 5 and 6 could theoretically be manufactured in any width or in any length depending upon the capabilities of the available knitting machines, typically many knitting machines presently available facilitate the production of a geosynthetic material about 12 feet wide, which often trimmed into widths of about 6 feet and lengths about 150 to 300 feet long for ease of use and installation.

Figure 7:
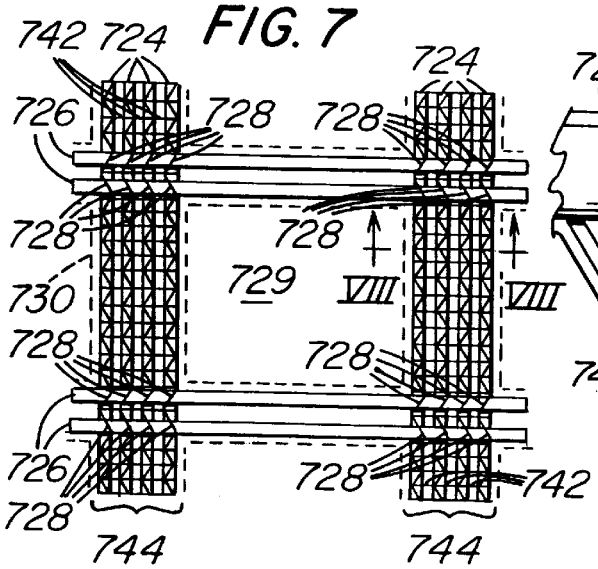
FIG. 7 is a top plan view similar to that of FIG. 5 illustrating an alternative embodiment of the present invention.
Figure 8:
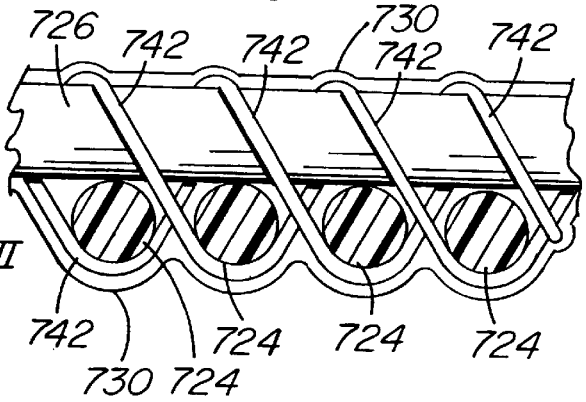
FIG. 8 is a cross sectional view along the line VIII—VIII of FIG. 7.

Referring now to FIGS. 7 and 8 there is illustrate an alternative embodiment of the present invention, which is similar to that described in connection with the discussion of FIGS. 5 and 6, but which illustrates ribs 744 each comprised of four ends or strands 724, which are intersected by weft strands 726, where pairs of weft strands 726 are shown maintained in closer spatial relationship than adjacent pairs of weft strands 726 to form weft ribs 746. Second tying member 742 affixes all four ends 724 within a rib 744 to one another. A section along the line VIII—VIII of FIG. 7 is shown in FIG. 8, which illustrates the bonding agent 730. The remaining elements illustrated in FIGS. 7 and 8, namely intersection 727, tying members 728, opening 729, bonding agent 730, and second tying members 742 are as described in connection with similar elements in the previous figures.

As may be appreciated the present invention is not limited to the embodiments illustrated in FIGS. 5–8 in terms of ends per rib or groups of weft strands, but are only illustrative. Any combination of ends per rib and weft strand groupings and relative spacings therebetween are contemplated as within the scope of the present invention.

Figure 9A:
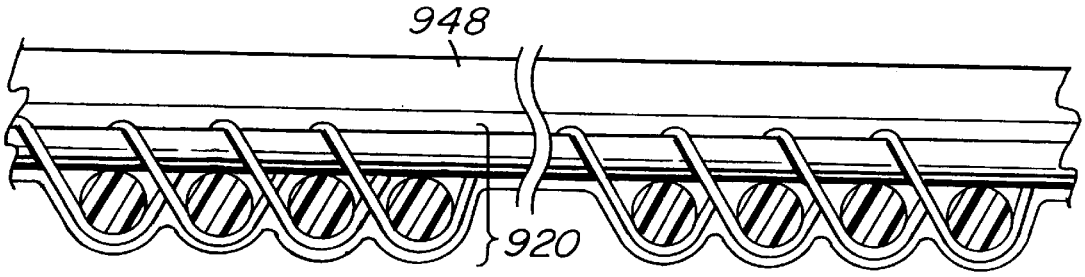
FIGS. 9A, 9B and 9C are cross-sectional views similar to that of FIG. 8 illustrating alternative embodiments of the present invention in which a second geosynthetic material is associated with a first geosynthetic material.
Figure 9B:
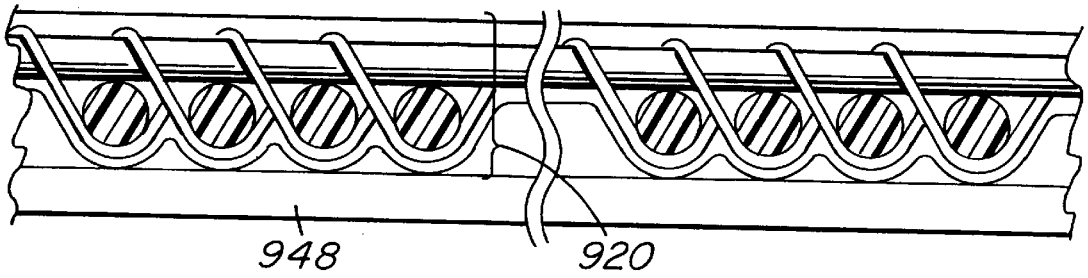
Figure 9C:
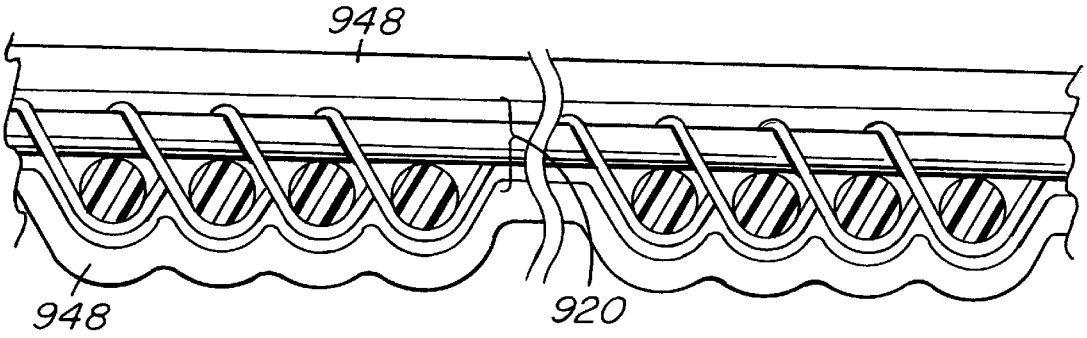

Referring now to FIGS. 9A, 9B and 9C, respectively, there is illustrated the positioning of a second geosynthetic material 948 adjacent to one or more sides of the geosynthetic material 920 to form a composite. The geosynthetic material 920 is identical to the geosynthetic material 720 described in connection with the discussion of FIG. 7.

The second geosynthetic material 948 may be associated with the geosynthetic material by any means known in the art. This includes, but is not limited to any mechanical forms of attachment (i.e. knitting, stitching, etc.), chemical forms of attachment (i.e. bonding agents such as glues and the like) or combinations thereof.

The attachment may be made over all or a large surface of the second geosynthetic material 948 and/or the geosynthetic material 920, or it may be attached only over a portion, as around a perimeter of either the geosynthetic material 920 and/or the second geosynthetic material 948.

In still another embodiment of the present invention as illustrated in FIG. 9C the second geosynthetic material 948 may be present over both sides of the geosynthetic material 920. In this embodiment, the second geosynthetic material 948 may be in the form of two sheets associated with opposite sides of the geosynthetic material 920. Alternatively, or the geosynthetic material 920 may be embedded within the second geosynthetic material 948, as for example, where the second geosynthetic material 948 is caused to flow over and about the geosynthetic material 920 to form a film or sheet having the geosynthetic material 920 embedded therein.

The second geosynthetic material 948 may be permeable, semi-permeable or impermeable and/or combinations thereof, to water or other liquids thereby functioning anywhere from a filter to a liquid impermeable membrane. The second geosynthetic material 948 may be an interwoven material, non-interwoven material, or a nonwoven fabric or scrim.

The second geosynthetic material 948 may be selected from the group consisting of natural materials, polymeric materials including thermoplastic or thermosetting materials, inorganic materials including metal films, foils, grids, and the like, or combinations thereof. Where the second geosynthetic material includes a polymeric material it may be in the form of a polymeric film and/or a geosynthetic textile fabric.

Figure 10:
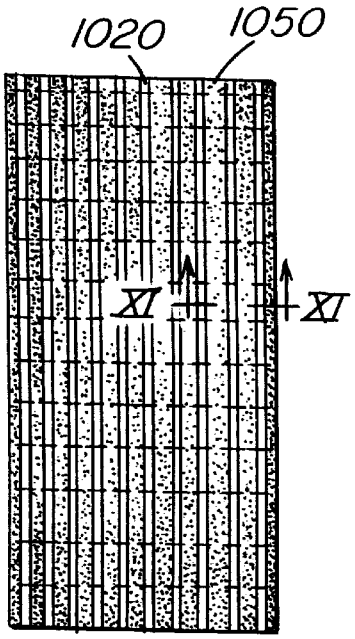
FIG. 10 is a top plan view of an alternative embodiment of the present invention illustrating the association of a nonwoven geosynthetic material with a first geosynthetic material.
Figure 11:
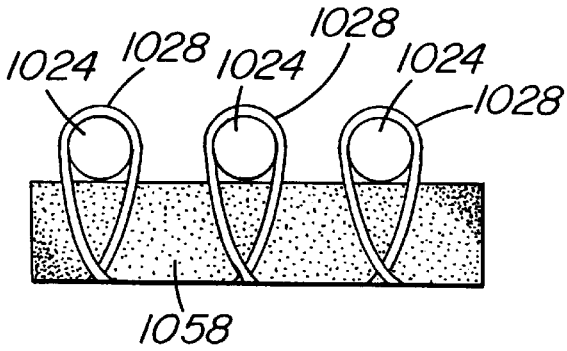
FIG. 11 is a cross sectional view along the line XI—XI of FIG. 10.

Referring to FIGS. 10 and 11 there is illustrated an alternative embodiment of the present invention wherein a plurality of spaced apart generally parallel fiber strands of the present invention are affixed over a nonwoven geosynthetic material. More particularly, as shown in FIGS. 10 and 11, a plurality of strands 1024, e.g. warp strands, are affixed by one or more tying members 1028 to a nonwoven geosynthetic material 1050. The nonwoven geosynthetic material may be comprised of organic fibers including polymeric fibers and natural fibers, inorganic fibers, or combinations thereof. Other examples of nonwoven geotextiles are those which consistent of staple fiber versus continuous filaments. Fiber entangling methods of nonwoven geotextiles, using either staple or continuous filaments include: needlepunching, heat bonding, spunbonding and adhesive or compound bonding. All combinations described above, and other possible combinations may be used in this composite. As a non-limiting example, the nonwoven geosynthetic material may be a continuous filament nonwoven polypropylene geotextile which is reinforced by the uniaxial fibers 1024 shown in FIGS. 10 and 11.

Figure 12:
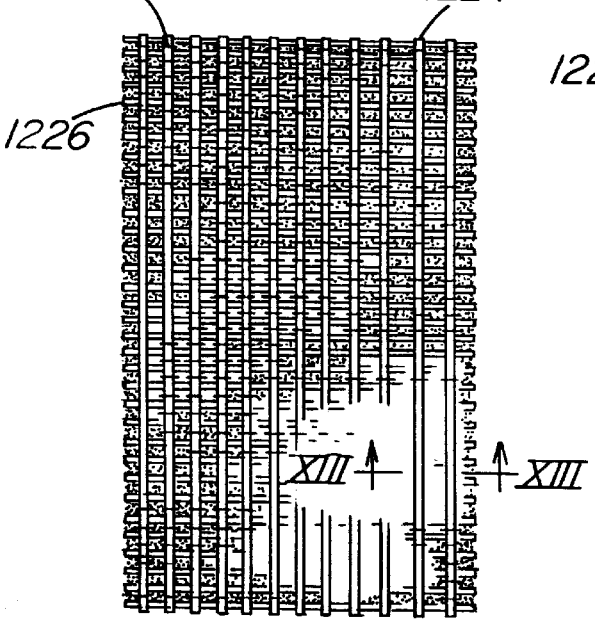
FIG. 12 is a top plan view similar to FIG. 10 illustrating the incorporation of a plurality of warp and weft strands with a nonwoven geosynthetic material.
Figure 13:
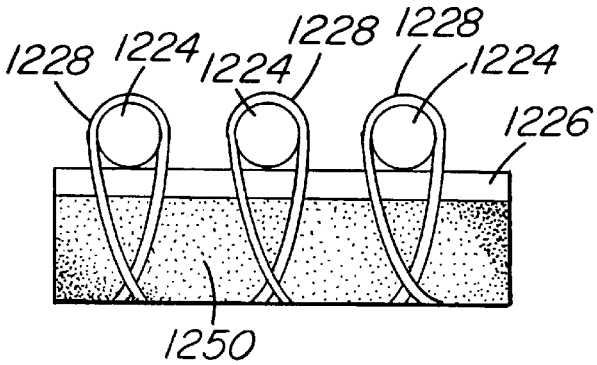
FIG. 13 is a cross sectional view along the line XIII—XIII of FIG. 12.

In an alternative embodiment as illustrated in FIGS. 12 and 13, in addition to a first plurality of spaced apart generally parallel fibers 1224, e.g. warp strands affixed to nonwoven geosynthetic material 1250 by tying member 1228, a second plurality of generally parallel fiber strands 1226, e.g. weft strands, may be positioned adjacent to and form a plurality of intersections 1227 with fibers 1224. The second plurality of fiber strands 1226 may be affixed to the nonwoven geosynthetic material 1250 by any means known in the art, including tying member 1228. The second plurality of fiber strands 1226 may or may not be spaced apart, and are illustrated in FIG. 12 in a non-spaced apart pattern.

The embodiments of the present invention illustrated in FIGS. 10, 11, 12 and 13 are representative and non-limiting, as other embodiments are contemplated as within the scope of the present invention. In particular, embodiments incorporating elements illustrated in the remaining drawings may be incorporated in the embodiments illustrated in FIGS. 10,11,12 and 13. For example, the geosynthetic material illustrated in FIGS. 1, 3A, 3B, 3C, 4A, 4B, 5, 6, 7, 8, 9A, 9B, 9C and combinations thereof, may be affixed to the nonwoven geosynthetic material 1250. In addition, any of the aforementioned combinations of geosynthetic materials with the nonwoven geosynthetic material 1250 may or may not be overcoated with a bonding agent such as bonding agent 30 illustrated in FIG. 1.

A particularly advantageous aspect of the use of the nonwoven geosynthetic material 1250 is that it provides improved in-plane drainage capacity to allow the dissipation of pore water and seepage water, speeding consolidation, increasing soil friction characteristics, pullout resistance and seismic stability.

The geosynthetic materials of the present invention described above are useful for reinforcing a wide variety of soil materials in many engineering applications. As used herein, "soil material" includes earthen material including but are not limited to one or more of the following components: inorganic mineral soils, organic materials, metallic waste materials such as chromium or lead, and fossil fuel waste materials such as fly ash and bottom ash. Soil material does not include asphalt or concrete materials.

Suitable inorganic mineral soils are selected from the group consisting of gravel, sand, silt, clay and mixtures thereof. As used herein, "gravel" includes particles of rocks with occasional particles of quartz, feldspar and other minerals. B. Das, *Principles of Geotechnical Engineering,* (3d Ed. 1994) at page 7, which is hereby incorporated by reference. "Sand" includes silicon dioxide sediment particulates such as quartz and feldspar. *Principles of Geotechnical Engineering* at page 7. As used herein, "silt" includes microscopic soil fractions that consist of very fine quartz grains and some flake-shaped particles that are fragments of micaceous minerals which have a plasticity index of 10 or less. *Principles of Geotechnical Engineering* at page 7. "Clay" includes one or more hydrated aluminum silicates. *Hawley's* (3d Ed. 1993) at page 288, which is hereby incorporated by reference.

The soil material can be formed from an aqueous soil mixture obtained by excavating dredge material from the floor of a body of water, such as a river, lake, channel or preferably from an ocean. Dredge material generally comprises one or more of the mineral soils and water as discussed in detail above. Dredge material preferably also comprises one or more organic materials such as are discussed above.

Figure 14:
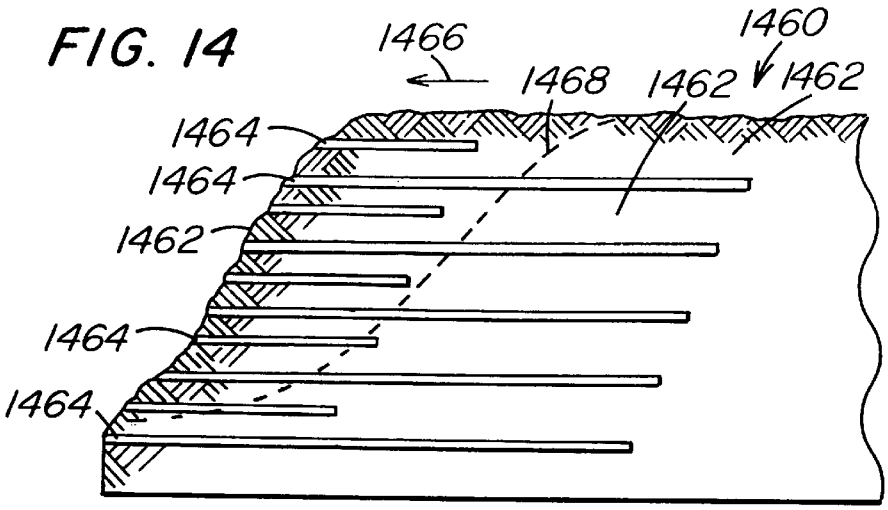
FIG. 14 is an a cross sectional view illustrating the use of the geosynthetic material of the present invention in a steep slope.

Referring now to FIG. 14 there is illustrated a non-limiting application of a use of the geosynthetic material of the present invention. Illustrated is a cross sectional view of a reinforced soil composite 1460 in the form of a sloped embankment 1461 which includes layers 1462 of soil material having a geosynthetic material 1464 in accordance with the present invention disposed therebetween. Tensile load is applied on the soil composite in the direction of arrow 1466, along a shear line 1468, shown in phantom in FIG. 14. In the soil composite shown in FIG. 14, the strain is directed along a line in the direction of arrow 1466. Therefore, it is preferable that the warp strands are oriented along a line parallel to the direction of arrow 1466, and that the warp strands of the geosynthetic material 1464 include at least a portion of glass fiber strands to minimize strain under tensile loading, thus reinforcing the embankment 1461 and providing stabilization of the soil material 1462 and in turn, the embankment 1461.

Figure 15:
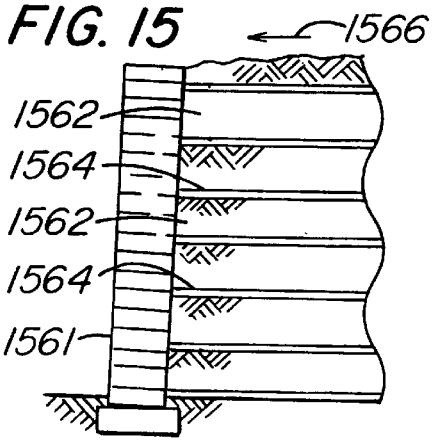
FIG. 15 is a cross sectional view illustrating the use of the geosynthetic material of the present invention in a retaining wall.

Referring now to FIG. 15, there is illustrated an alternative non-limiting application of the use of the geosynthetic material of the present invention. Illustrated in a cross sectional view of a reinforced soil composite 1560 in the form of a block wall 1561 which includes therebehind layers 1562 of soil material having a geosynthetic material 1564 in accordance with the present invention disposed therebetween. Tensile load is applied on the soil composite in the direction of arrow 1566. In the soil composite shown in FIG. 15, the strain is directed along a line in the direction of arrow 1566. Therefore, it is preferable that the warp strands are oriented along a line parallel to the direction of arrow 1566, and that the warp strands of the geosynthetic material 1564 include at least a portion of glass fiber strands to minimize strain under tensile loading, thus reinforcing the wall 1561 and providing stabilization of the soil material 1562 and in turn, the wall 1561.

Figure 16:
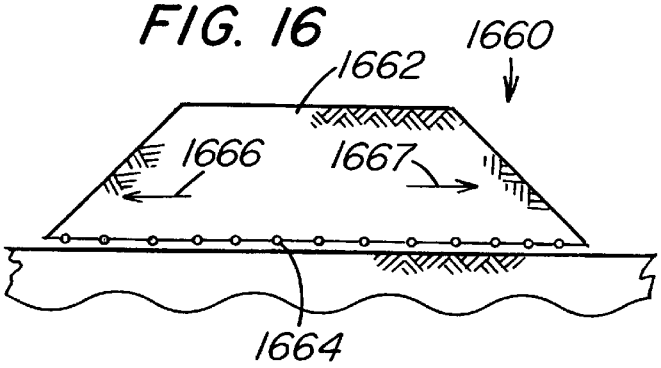
FIG. 16 is a cross sectional view illustrating the use of the geosynthetic material of the present invention in a reinforced embankment.

Referring now to FIG. 16 there is shown a cross sectional view of yet another non-limiting application of the geosynthetic material of the present invention. Illustrated in a cross sectional view of a reinforced soil composite 1660 in the form of a reinforced embankment 1662 having a geosynthetic material 1664 in accordance with the present invention embedded therein. Examples of the use of such a reinforced embankment among others, include a dike or a built-up roadway support base through a low lying lands. Tensile load is applied on the soil composite in the directions of arrows 1666 and 1667. In the soil composite shown in FIG. 16, the strain is directed along a line in the direction of arrows 1666 and 1667. Therefore, it is preferable that the warp strands are oriented along a line parallel to the direction of arrows 1666 and 1667, and that the warp strands of the geosynthetic material 1664 include at least a portion of glass fiber strands to minimize strain under tensile loading, thus stabilizing the reinforced embankment 1662.

Figure 17:
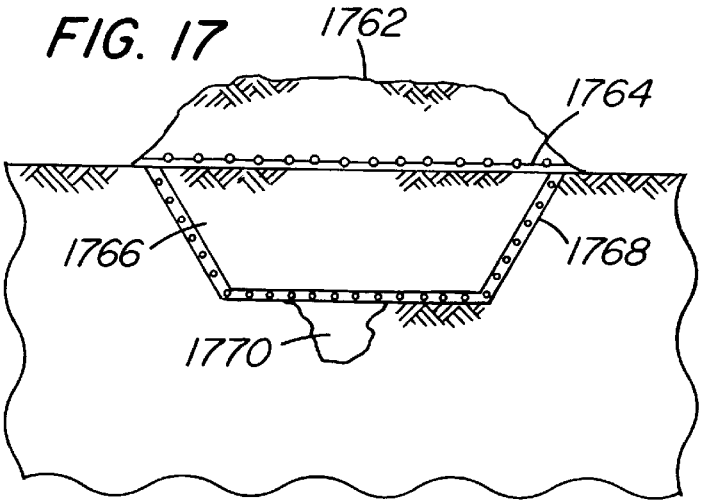
FIG. 17 is a cross sectional view illustrating the use of the geosynthetic material of the present invention in a landfill.

Referring now to FIG. 17 there is yet another non-limiting example of the use of the geosynthetic material of the present invention in a landfill application as part of a land fill or waste disposal area. Illustrated in FIG. 17 is a waste material 1762 reinforced with a geosynthetic material 1764 similar to the geosynthetic material 1664 of FIG. 16. Under the waste material 1762 is illustrated a landfill 1766, which landfill 1766 is lined with a geosynthetic material 1768 of the present invention. In the process of landfilling, it is possible for waste material within or above the filled area to "sink" or settle, creating depressed areas or voids. Illustrated in FIG. 17 is such a void area 1770. The geosynthetic material of the present invention when employed in a landfill provides "void bridging" across the void area 1770 to prevent the void area's transmission through the landfill to additional waste material or soil material deposited above the landfill. When used in this application, it is preferred that both the warp and weft strands of the geosynthetic material comprise glass fibers to provide resistance to strain, as the strain forces are directed along both along the warp and weft directions of the geosynthetic material in this application.

Figure 18A:
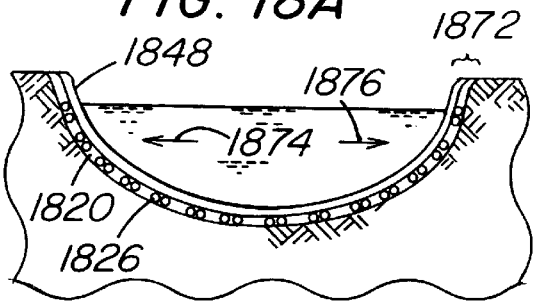
FIG. 18A is a cross sectional view illustrating the use of the geosynthetic material of the present invention as a pond liner.
Figure 18B:
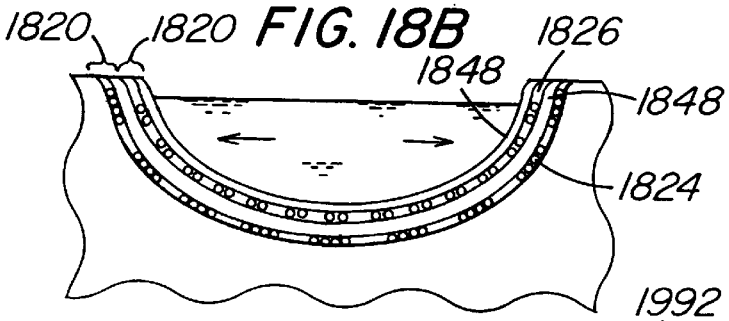
FIG. 18B is a cross sectional view similar to FIG. 18A illustrating the use of two layers of the geosynthetic material of the present invention as a pond liner.

Referring now to FIGS. 18A and 18B, there are shown cross sectional views of yet another non-limiting application of the geosynthetic material of the present invention as a reinforced pond liner. Illustrated in FIG. 18A is a pond of liquid 1870 such as for example water, which is retained by reinforced pond liner 1872. Pond liner 1872 includes geosynthetic material 1820 of the present invention which includes second geosynthetic material 1848 associated therewith, which may be associated as described in connection with the discussion of FIGS. 9A, 9B and 9C above. In this illustration, geosynthetic material 1848 is preferably water impermeable. The geosynthetic material 1820 also functions to prevent strain along the directions of sustained tensile load provided by the liquid as indicated by arrows 1874 and 1876 by providing glass fibers in the warp strand and orienting the warp strands along the lines indicated by the arrows 1874 and 1876. If instead of a pond of liquid 1870, FIGS. 18A and 18B illustrated a channel of liquid, the tensile load would have acted primarily along the direction represented by the arrows 1874 and 1876, generally transverse to the longitudinal direction of the channel. However, in some impoundment applications, additional or secondary sustained tensile loads may be expected perpendicularly to those represented by arrows 1874 and 1876 in a plane that would appear to emanate out of the page as FIG. 18A is viewed by an observer. While the geosynthetic material 1820 may be formed with glass fibers in both the warp and weft directions to accommodate such tensile loads, an alternative embodiment is illustrated in FIG. 18B. Illustrated in FIG. 18B is a second layer of geosynthetic material 1820, which may or may not include second geosynthetic material 1848 associated therewith, placed either above or below the first layer of geosynthetic material 1820. The second layer of geosynthetic material is placed with its load bearing fibers, e.g. its warp strands, transversely to the first layer of geosynthetic material and along a direction parallel to the secondary tensile load described above. Thus, employing the embodiment of the geosynthetic material illustrated in FIGS. 7 and 8 in FIG. 18B by way of a non-limiting example, the warp ribs which included 4 ends per rib are illustrated as rib ends 1880 and the weft strands which were grouped in pairs, are illustrated in FIG. 18B as strands 1882.

Figure 19:
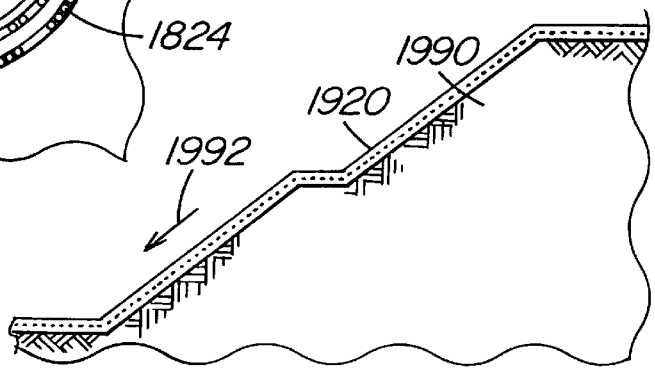
FIG. 19 is a cross sectional view illustrating the use of the geosynthetic material of the present invention as a steep slope veneer reinforcement.

Referring now to FIG. 19 there is illustrated yet another non-limiting application of the geosynthetic material of the present invention as a veneer reinforcement. Illustrated in FIG. 19 is a steep slope 1990 having disposed on its face a geosynthetic material 1920 of the present invention. While any of the embodiments of the geosynthetic material of the present invention disclosed may be used in this application, the embodiments disclosed which included a nonwoven geosynthetic fabric are particularly useful as they provide, in addition to tensile reinforcement, an exceptional in-plane drainage capacity to allow the dissipation of liquids such as pore water and seepage water. The tensile load applied to the geosynthetic material 1920 may be expected along the direction indicated by the arrow 1992, and it is along this direction that the tensile load bearing fibers of the geosynthetic material of the present invention should be oriented to minimize strain under loading.

One skilled in the art would understand that the foregoing applications are only exemplary, and that the geosynthetic material of the present invention can be used in a wide variety of soil reinforcement applications, including geotechnical engineering applications such as load bearing applications, road and building foundations, slopes, fill, artificial coastlines and islands, levies, sound barriers, erosion control, soil stabilization and vegetation support.

The geosynthetic material of the present invention exhibits significantly less strain than polymerically-based geosynthetic materials presently available. As noted above, strain as used in connection with geosynthetic materials, is measure of the change in length of a geosynthetic material over an initial length when that material is subjected to a tensile load. Strain is often determined when determining the ultimate tensile strength of a geosynthetic material. The ultimate tensile strength is generally determined by subjecting the geosynthetic material "as manufactured" to an increasing tensile load until it fails or ruptures. This tensile load may be applied to either an individual portion of the geosynthetic material (i.e. as for example in accordance with the Single Rib Test in accordance with the Geosynthetic Research Institute's (GRI) Test Method GG1 (incorporated herein by reference)) or to larger portion (e.g. the Wide Width Tensile Strength as described in ASTM D 4595 (incorporated herein by reference)). The change in length of the geosynthetic material as the tensile load is applied to failure provides both the strain and the ultimate tensile strength test for the geosynthetic material so tested. In comparisons between the ultimate tensile strengths of the novel geosynthetic material of the present invention and that of the presently available polymerically-based geosynthetic materials, it has been found that the novel geosynthetic material of the present invention may be expected to exhibit a maximum strain of about 2 to 4% whereas the presently available polymerically-based geosynthetic materials may be expected to exhibit a strain at maximum tensile load of about 15% to about 30%.

The novel geosynthetic material of the present invention is also less subject to fluctuations in strain due to variations in temperature. In contrast, the known polymerically-based geosynthetic materials generally exhibit substantially increased creep or strain as the temperature of such geosynthetic material is elevated.

The present invention will now be illustrated by the following specific non-limiting examples.

EXAMPLE 1

A geosynthetic material according to the present invention, more particularly a geosynthetic material similar to that as illustrated in FIG. 7, was formed with a first plurality of generally coplanar grouped strands having four strands per grouping (hereinafter the warp strands) with the warp strands being oriented in a spaced-apart generally parallel relationship along a machine direction to provide a plurality of warp ribs having four strands or ends in each rib. The individual warp strands were spaced about 0.04 inches (0.1 cm) from each other, and the warp ribs were spaced about 0.98 inches (2.5 cm) from each other. The four warp strands within each rib were maintained in the spaced apart relationship by knitting the strands with a polyester tying member having a denier of about 150.

A second plurality of grouped generally coplanar strands having 2 strands per group (hereinafter the weft strands), with the two strands in each group adjacent each ether, were provided in a cross machine direction to provide a plurality of weft strands. Each group of two weft strands was spaced from each other group of two weft strands by a distance of about 0.55 inches (1.4 cm). The warp strands the weft strands were oriented generally perpendicular to each other to form a plurality of intersections between the warp strands and the weft strands to form a grid having grid openings of about 0.98 inches (2.5 cm) by about 0.55 inches (1.4 cm). The warp strands and the weft strands were affixed to each other by the polyester tying member described above in a warp knit weft insertion knitting pattern on a Liba knitting machine. The warp strands and weft strands were not interwoven.

Each warp and weft strand was comprised of 2 substrands, each substrand comprised of about 1600 glass filaments or fibers each. The glass filaments were of the type manufactured by PPG Industries, Inc., of Pittsburgh, Pa. and marketed under the trade name HERCUFLEX 2000 and each filament had a diameter of about 0.0005 inches (13 microns). The glass fibers were individually sized with about a 1% non-starch sizing, and the substrands were coated with about a 10% by weight acrylic base coating as the substrands were joined to form the strands, in order to provide strength and flexibility to the strands.

The knitted warp strand/weft strand geosynthetic material was provided in about a 6 foot (1.83 m) width along the weft direction, and was cut into lengths of about 150 feet (45.72 m) long along the warp direction.

The knitted warp strand/weft strand geosynthetic material so formed was provided with a bonding agent. The bonding agent was applied by dipping the knitted warp strand/weft stand geosynthetic material into a bath of solvent based PVC to allow total immersion and coating of the material. This coated material then traversed through a drying oven with having a temperature in the range of about 280° F. (about 138° C.) to about 320° F. (about 160° C.) for about 2 to 5 minutes exposure. Upon emergence from the oven the geosynthetic material was bonded and dry having deposited thereon a polyvinyl chloride bonding agent which acted to adhere the warp strands, weft strands and polyester tying members to one another to form a strong but flexible geosynthetic material.

The ultimate tensile strength and strain under an initial tensile load for the geosynthetic material was measured for the geosynthetic material in its "as manufactured" state. The ultimate tensile strength and strain under an initial tensile load was measured along a single rib using the GRI GG1 "Single Rib Tensile Strength" test to measure the ultimate tensile strength and tensile elongation. In this test, the weft strands were severed along a portion of a warp rib, and a warp rib comprised of 4 ends or strands was subjected to an increasing tensile load until failure was observed. The tensile strength at failure (e.g. the ultimate tensile strength) and the elongation at failure (e.g. the strain under an initial tensile load) were observed. As may be appreciated, the method of applying the tensile load may affect the test results, as for example, where a clamping mechanism damages the warp strands causing failure at the clamp/strand interface. It was determined that wrapping opposite ends of the rib being tested around respective drum or roller clamps and separating the drum clamps from one another so as to apply a tensile load along the rib (during which friction held the ends of the rib as opposed to a clamping mechanism), provided a more accurate measure of the ultimate tensile strength and strain under an initial tensile load for the geosynthetic material of the present invention, as opposed to clamping devices commonly used to test polymerically based geosynthetic materials. As may be appreciated, because the polymerically based geosynthetic materials presently available exhibit such significant strain under an initial tensile load (about 15–30%), the effect of the clamping device on such elastic material is not as significant as the geosynthetic material of the present invention, which exhibits far less strain under an initial tensile load (e.g. about 2–4%).

Thirty five such single ribs were tested individually and the results for the initial or baseline tensile strengths and elongations at failure are reported in the respective baseline columns shown in Table 1 below. The ribs were found to have had an average baseline tensile strength of about 366 pounds (166 kg) at failure and an average 3% elongation at failure. By observing the percent elongation per pounds stress applied, it was possible to obtain a load/strain plot for the material which is illustrated as line A in FIG. 20.

These results were compared with known load/strain plots for two presently available polymerically-based polymeric geosynthetic materials having similar initial tensile strengths and elongations. The first of these known polymeric geosynthetic materials was a product available under the tradename "STRATAGRID 300" geosynthetic material available from Strata Systems, Inc., of Cumming, Ga. It is comprised of a ribs having three ends or strands per rib in a warp or machine direction, and a plurality of single spaced apart generally parallel weft strands. The warp and weft strands are each comprised of 1000 Denier polyester strands, which are a high tenacity, high modulus high molecular weight polyester multifilament fiber such as that available from Allied Fibers of North Carolina under the tradename Allied Type 002 fibers. The STRATAGRID 300 is formed by warp knit weft insertion knitting, where the tying member affixing the warp strands into the rib is comprised of 450 Denier textured polyester. The knitted warp and weft strands are overcoated with a polyvinyl chloride bonding agent applied by the dipping process. The opening size of the STRATAGRID 300 geosynthetic material is about 0.60 inches (1.52 cm) in a machine direction by about 1.56 inches in a cross machine direction, and it comprises in a machine direction about 15.8 ribs per foot (15.8 ribs per 0.30 m) with about 7.1 weft strands per foot (7.1 weft strands per 0.30 m) in a cross machine direction. The thickness of each warp and weft strand is nominally about 0.52 inches (1.32 cm). The STRATAGRID 300 geosynthetic material has an average as manufactured initial tensile strength per warp rib of about 240 pounds (108 kg), and an average as manufactured percent elongation per warp rib at failure of about 15%.

The second of these known polymeric geosynthetic materials was a product available under the tradename "STRATAGRID 500" geosynthetic material available from Strata Systems, Inc., of Cumming, Ga. It is comprised of a ribs having six ends or strands per rib in a warp or machine direction, and a plurality of paired spaced apart generally parallel weft strands. The paired weft strands are not equidistant along the warp direction, but are themselves spaced in pairs along the warp direction. The warp and weft strands are each comprised of 1000 Denier Allied Type 002 polyester strands. It is formed by warp knit weft insertion knitting, where the tying member affixing the warp strands into the rib is comprised of 450 Denier textured polyester. The knitted warp and weft strands are overcoated with a polyvinyl chloride bonding agent applied by the dipping process. The opening size of the STRATAGRID 500 geosynthetic material is about 1.0 inches (2.54 cm) in a machine direction by about 2.3 inches (5.8 cm) in a cross machine direction, and it comprises in a machine direction about 7.7 ribs per foot (7.7 ribs per 0.30 m) with about 3.8 weft strands per foot (3.8 weft strands per 0.30 m) in a cross machine direction. The thickness of each warp and weft strand is nominally about 0.5 inches (1.27 cm). The STRATAGRID 500 geosynthetic material has an average as manufactured initial tensile strength per warp rib of about 650 pounds (295 kg) and an average as manufactured percent elongation per warp rib at failure of about 15%.

Figure 20:
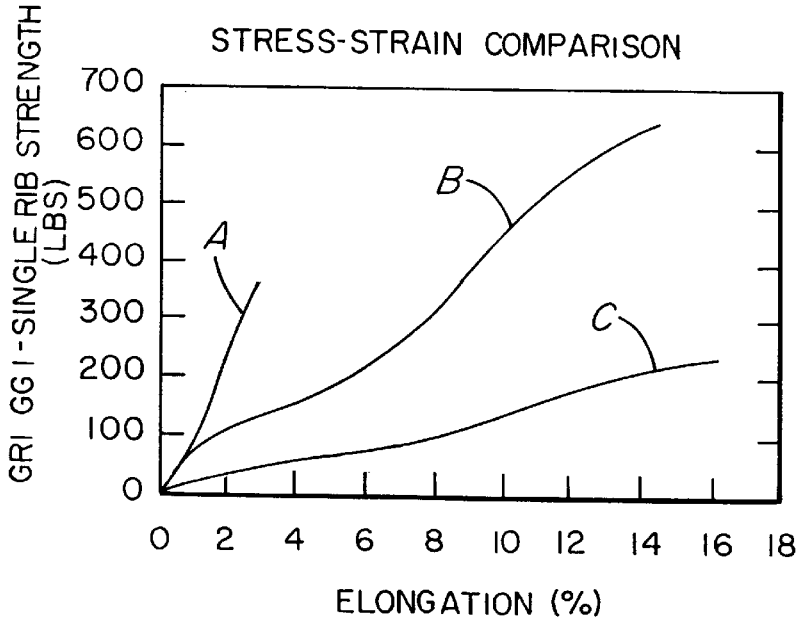
FIG. 20 is a graph comparing the stress strain properties of the geosynthetic material of the present invention with that of presently available geosynthetic materials.

Referring now to FIG. 20, there is shown a load/strain comparison test with the load/strain plot for the STRATAGRID 300 geosynthetic material designated as line B and the load/strain plot for the STRATAGRID 500 material designated as line C.

A comparison of the load/strain curves illustrated in FIG. 20 clearly demonstrates the significant reduction in the percent elongation of the novel geosynthetic material of the present invention as a function of load in pounds versus that of the similar known polymerically-based geosynthetic materials.

EXAMPLE 2

The novel geosynthetic material of the present invention prepared in accordance with Example 1 was subjected to testing to determine the effect of installation damage on tensile elongation and tensile strength. The geosynthetic material was subjected to a procedure that simulated damage as might be expected when the geosynthetic material was installed under field conditions.

In this simulated damage procedure, a metal base plate was overcoated with about 10 inches (25.4 cm) of soil material, the soil material comprising subangular to angular flexible crushed base course. A section of the novel geosynthetic material of Example 1, measuring about 55 inches (139.7 cm) by about 45 inches (114.3 cm) was placed over the soil material. Another soil layer comprising the same soil material just described was deposited over the geosynthetic material to a thickness of about 6 inches (15.24 cm). The soil material/geosynthetic material composite was compacted with a vibrating roller compactor to a compaction density of about 90 to 95% of the modified proctor, ASTM 1557, compaction density for this soil material. This procedure was believed to simulate damage as might be expected to the geosynthetic material when heavy machinery traverses the geosynthetic material as it is being installed under field conditions.

The geosynthetic material was then removed from soil by raising one end of the metal plate to about a 45 degree angle, and allowing the soil material to fall off in order to recover the geosynthetic material without applying additional force to recover the geosynthetic material from the test soil.

Thirty-six warp ribs of the geosynthetic material subjected to the simulated damage procedure were then tested by the GRI GG1 Single Rib Tensile test described above to determine tensile strength and percent tensile elongation after exposure to the simulated damage procedure. The results of that testing are reported in Table 1 below in the columns labeled "Exposed".

TABLE 1

| | Single Rib Tensile Strength (lbs) | | | | Single Rib Tensile Elongation (%) | | | |
|---|---|---|---|---|---|---|---|---|
| Rib Number | Baseline* | Exposed** | % lost | % retention | Baseline* | Exposed** | % lost | % retention |
| 1 | 353 | 276 | −21.8 | 78.2 | 3.0 | 2.4 | −20.0 | 80.4 |
| 2 | 356 | 326 | −8.4 | 91.6 | 2.8 | 2.7 | −3.6 | 96.4 |
| 3 | 362 | 387 | −20.7 | 79.3 | 2.9 | 2.9 | 0.0 | 100.0 |

TABLE 1-continued

| | Single Rib Tensile Strength (lbs) | | | | Single Rib Tensile Elongation (%) | | | |
|---|---|---|---|---|---|---|---|---|
| Rib Number | Baseline* | Exposed** | % lost | % retention | Baseline* | Exposed** | % lost | % retention |
| 4 | 365 | 333 | −8.8 | 91.2 | 3.0 | 2.6 | −13.3 | 86.7 |
| 5 | 392 | 380 | −3.1 | 96.9 | 3.5 | 2.9 | −17.1 | 82.9 |
| 6 | 280 | 208 | −25.7 | 74.3 | 2.7 | 2.2 | −18.5 | 81.35 |
| 7 | 373 | 334 | −10.5 | 89.5 | 2.9 | 2.7 | −6.9 | 93.1 |
| 8 | 356 | 321 | −9.8 | 90.2 | 3.1 | 2.8 | −9.7 | 90.3 |
| 9 | 328 | 327 | −0.3 | 99.7 | 2.6 | 2.6 | 0.0 | 100.0 |
| 10 | 334 | 333 | −0.3 | 99.7 | 3.0 | 3.1 | 3.3 | 103.3 |
| 11 | 398 | 348 | −12.6 | 87.4 | 3.3 | 2.8 | −15.2 | 84.8 |
| 12 | 396 | 377 | −4.8 | 95.2 | 3.2 | 3.0 | −6.3 | 93.8 |
| 13 | 363 | 351 | −3.3 | 96.7 | 2.7 | 3.0 | 11.1 | 111.1 |
| 14 | 344 | 352 | 2.3 | 102.3 | 2.9 | 3.0 | 3.4 | 103.4 |
| 15 | 344 | 329 | −4.4 | 95.6 | 3.0 | 2.8 | −6.7 | 93.3 |
| 16 | 476 | 390 | −18.1 | 81.9 | 3.1 | 2.7 | −12.9 | 87.1 |
| 17 | 329 | 296 | −10.0 | 90.0 | 2.7 | 2.6 | −3.7 | 96.3 |
| 18 | 344 | 305 | −11.3 | 88.7 | 2.9 | 2.9 | 0.0 | 100.0 |
| 19 | 364 | 299 | −17.9 | 82.1 | 3.2 | 2.5 | −21.9 | 78.1 |
| 20 | 406 | 343 | −15.5 | 84.5 | 3.3 | 3.0 | −9.1 | 90.9 |
| 21 | 457 | 272 | −40.5 | 59.5 | 3.2 | 2.4 | −25.0 | 75.0 |
| 22 | 324 | 263 | −18.8 | 81.2 | 2.9 | 3.1 | 6.9 | 106.9 |
| 23 | 350 | 285 | −18.6 | 81.4 | 3.0 | 2.5 | −16.7 | 83.3 |
| 24 | 352 | 307 | −12.8 | 87.2 | 3.0 | 2.7 | −10.0 | 90.0 |
| 25 | 357 | 314 | −12.0 | 88.0 | 2.8 | 3.0 | 7.1 | 10.71 |
| 26 | 346 | 298 | −13.9 | 86.1 | 3.1 | 2.8 | −9.7 | 90.3 |
| 27 | 366 | 304 | −16.9 | 83.1 | 2.9 | 2.7 | −6.9 | 93.1 |
| 28 | 418 | 349 | −16.5 | 83.5 | 3.3 | 2.8 | −15.2 | 84.8 |
| 29 | 403 | 321 | −20.3 | 79.7 | 3.0 | 2.7 | −10.0 | 90.0 |
| 30 | 392 | 327 | −16.6 | 83.4 | 3.3 | 2.6 | −21.2 | 78.8 |
| 31 | 310 | 274 | −11.6 | 88.4 | 2.9 | 2.7 | −6.9 | 93.1 |
| 32 | 351 | 263 | −25.1 | 74.89 | 3.0 | 2.6 | −13.3 | 86.7 |
| 33 | 378 | 300 | −20.6 | 79.4 | 3.1 | 2.4 | −22.6 | 77.4 |
| 34 | 369 | 278 | −24.7 | 75.3 | 3.0 | 2.5 | −16.7 | 83.3 |
| 35 | 347 | 294 | −15.3 | 84.7 | 3.0 | 2.6 | −13.3 | 86.7 |
| 36 | 383 | 336 | −12.3 | 87.7 | 3.1 | 2.7 | −12.9 | 87.1 |
| Avg: | 366 | 314 | −14.2 | 85.8 | 3.0 | 2.7 | −9.6 | 90.4 |

*"Baseline" refers to measured values of the grid as manufactured and before exposure to a simulated damage procedure.
**"Exposed" refers to measured values of the grid after exposure to the simulated damage procedure.

Figure 21:
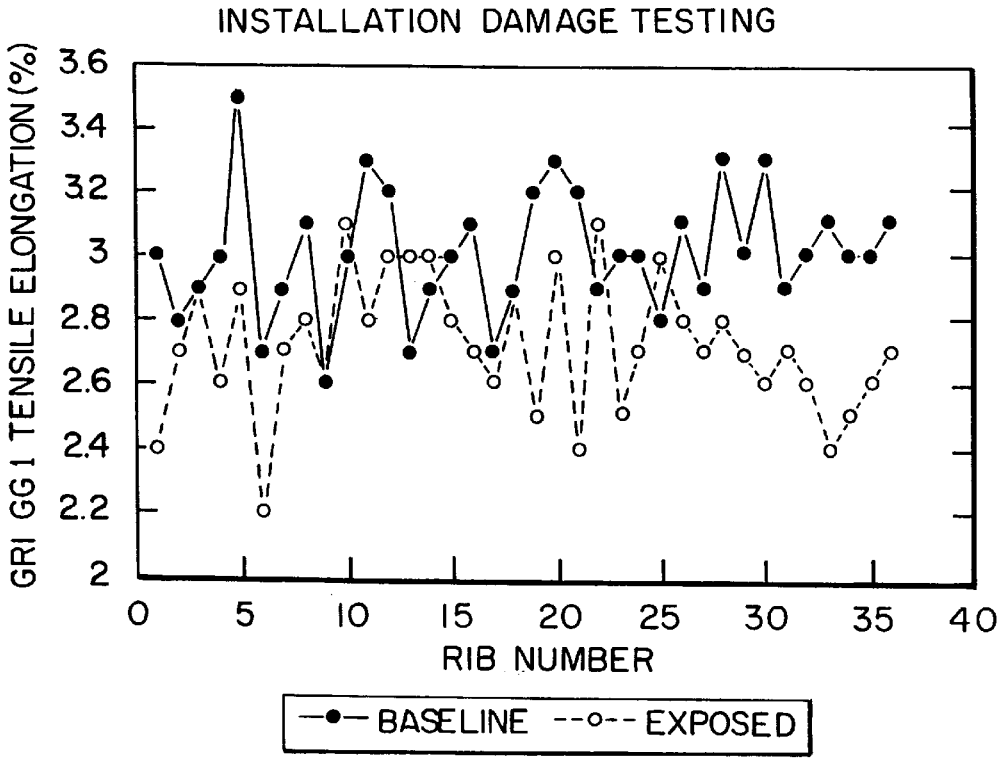
FIG. 21 is a graph of percent tensile elongation as a function of rib number for a preferred embodiment of a geosynthetic material of the present invention before and after simulated soil reinforcement installation damage to the material.

A graph of tensile elongation (in percent) as a function of rib number for the geosynthetic material of the present invention before and after simulated soil reinforcement installation damage to the material is illustrated in FIG. 21 wherein it is shown that there was very little decrease in the tensile elongation before and after simulated damage procedure, indicating that the geosynthetic material of the present invention is very durable and can withstand installation damage without any appreciable change in elongation.

Figure 22:
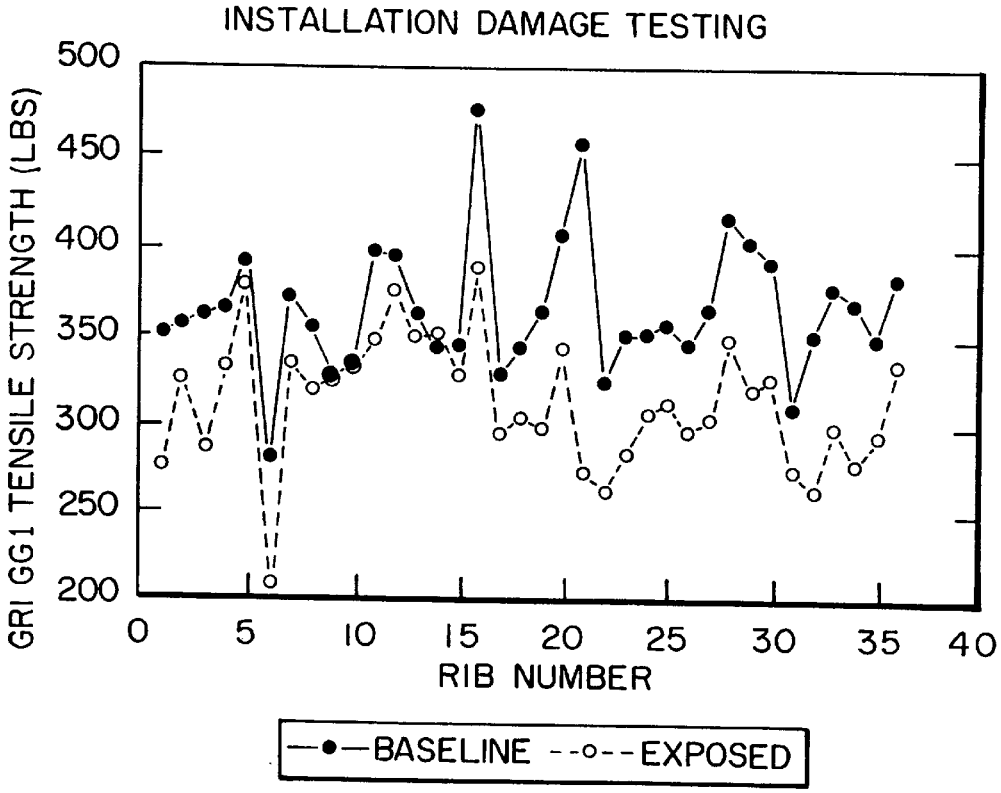
FIG. 22 is a graph of tensile strength as a function of rib number for a preferred embodiment of a geosynthetic material of the present invention before and after simulated soil reinforcement installation damage to the material.

A graph of tensile strength as a function of rib number for the geosynthetic material of the present invention before and after simulated soil reinforcement installation damage to the material is illustrated in FIG. 22 wherein it is shown that there was very little decrease in the tensile strength before and after the simulated damage procedure, indicating that the geosynthetic material of the present invention is very durable and can withstand installation damage without appreciable loss of tensile strength.

From the foregoing description is can be seen that the present invention provides a geosynthetic material that has a much higher strength to weight ratio, providing a geosynthetic material with far less elongation at comparable tensile strength than similar polymeric geosynthetic materials presently available. The use of glass fibers to provide a novel geosynthetic material that does not suffer from substantial strain under tensile load, ultraviolet radiation sensitivity and/or the biological/chemical sensitivity common to some of the polymerically based geosynthetic materials presently available. The present invention is easier to manufacture and is less expensive to produce than polymeric geosynthetic materials presently available. In addition, the density of the geosynthetic material of the present invention is similar to that of saturated soil materials, which lessens the likelihood of movement of the novel geosynthetic materials of the present invention when installed in saturated or supersaturated soil-reinforcing applications.

It will be appreciated by those skilled in the art that changes could be made to the embodiments described above without departing from the broad inventive concept thereof. It is understood, therefore, that this invention is not limited to the particular embodiments disclosed, but it is intended to cover modification which are within the spirit and scope of the invention, as defined by the appended claims.

What is claimed is:

1. A geosynthetic material for reinforcing a soil material to form a reinforced soil composite, the geosynthetic material comprising:

(a) a first plurality of spaced-apart generally parallel fiber strands, wherein the first plurality of fiber strands includes fibers coated with an essentially dried residue of a first sizing composition and a first base coating composition comprising film-forming materials applied over the first sizing composition such that at least a portion of the first plurality of fiber strands are impregnated with the first base coating composition, and further wherein at least a portion of the first plurality of fiber strands comprises glass fibers;

(b) a second plurality of spaced-apart generally parallel fiber strands positioned adjacent to and forming a plurality of intersections with at least a portion of the first plurality of strands, wherein the second plurality of fiber strands includes fibers coated with an essentially dried residue of a second sizing composition and a second base coating composition comprising film-forming materials applied over the second sizing composition such that at least a portion of the second plurality of fiber strands are impregnated with the second base coating composition, and further wherein at least a portion of the second plurality of fiber strands comprise glass fibers;

(c) a first tying member fixedly connecting portions of fiber strands of the first plurality of fiber strands with intersecting corresponding portions of the second plurality of fiber strands;

(d) a second tying member fixedly connecting at least two adjacent generally parallel spaced fiber strands of the first plurality of fiber strands; and (e) a bonding agent adhering predetermined regions of selected fiber strands of the first plurality of fiber strands with predetermined regions of selected fiber strands of the second plurality of fiber strands, wherein the bonding agent is applied over selected portions of the first and second base coating compositions, wherein the geosynthetic material resists chemical and biological attack from soil material.

2. The geosynthetic material according to claim 1, herein the fiber strands of the first plurality of fiber strands comprise glass fibers.

3. The geosynthetic material according to claim 2, wherein the fiber strands of the second plurality of fiber strands comprise fibers formed from materials selected from the group consisting of natural materials, thermoplastic materials and combinations thereof.

4. The geosynthetic material according to claim 1, wherein at least a portion of the fiber strands of the first plurality of fiber strands comprise fibers formed from materials selected from the group consisting of inorganic materials, natural materials, thermoplastic materials and combinations thereof.

5. The geosynthetic material according to claim 4, wherein the thermoplastic materials are selected from the group consisting of polyolefins, polyamides, thermoplastic polyurethanes, thermoplastic polyesters, acrylic polymers, vinyl polymers, acetals, polyaryl sulfones, polyether sulfones, polyimides, polyetherketones, polyphenylene oxides, polyphenylene sulfides and mixtures thereof.

6. The geosynthetic material according to claim 5, wherein the fiber strands of the first plurality of fiber strands comprise fibers formed from a thermoplastic material which is polyester.

7. The geosynthetic material according to claim 1, wherein the film-forming material of the base coating composition comprises an acrylic polymer.

8. The geosynthetic material according to claim 1, wherein the fiber strands of the first plurality of fiber strands are generally coplanar.

9. The geosynthetic material according to claim 1, wherein spacing between adjacent fiber strands of at least one portion of the fiber strands of the first plurality of fiber strands is different from spacing between adjacent strands of another portion of the fiber strands of the first plurality of fiber strands.

10. The geosynthetic material according to claim 1, wherein the fiber strands of the second plurality of fiber strands comprise glass fibers.

11. The geosynthetic material according to claim 1, wherein at least a portion of the fiber strands of the second plurality of fiber strands comprise fibers formed from materials selected from the group consisting of inorganic materials, natural materials, thermoplastic materials and combinations thereof.

12. The geosynthetic material according to claim 11, wherein the thermoplastic materials are selected from the group consisting of polyolefins, polyamides, thermoplastic polyurethanes, thermoplastic polyesters, acrylic polymers, vinyl polymers, acetals, polyaryl sulfones, polyether sulfones, polyimides, polyetherketones, polyphenylene oxides, polyphenylene sulfides and mixtures thereof.

13. The geosynthetic material according to claim 12, wherein the fiber strands of the second plurality of fiber strands comprise fibers formed from a thermoplastic material which is polyester.

14. The geosynthetic material according to claim 1, wherein the film-forming material of the base coating composition comprises an acrylic polymer.

15. The geosynthetic material according to claim 1, wherein the fiber strands of the second plurality of fiber strands are generally coplanar.

16. The geosynthetic material according to claim 1, wherein spacing between adjacent fiber strands of at least one portion of the fiber strands of the second plurality of fiber strands is different from spacing between adjacent strands of another portion of the fiber strands of the second plurality of fiber strands.

17. The geosynthetic material according to claim 1, wherein at least a portion of the fiber strands of the first plurality of fiber strands and a portion of the fiber strands of the second plurality of fiber strands are interwoven.

18. The geosynthetic material according to claim 1, wherein the fiber strands of the first plurality of fiber strands and the fiber strands of the second plurality of fiber strands are not interwoven.

19. The geosynthetic material according to claim 1, wherein the first tying member is formed from a material selected from the group consisting of inorganic materials, natural materials, thermoplastic materials, thermosetting materials and combinations thereof.

20. The geosynthetic material according to claim 19, wherein the first tying member is formed from a thermoplastic material which is polyester.

21. The geosynthetic material according to claim 1, wherein the second tying member is formed from a material selected from the group consisting of inorganic materials, natural materials, thermoplastic materials, thermosetting materials and combinations thereof.

22. The geosynthetic material according to claim 21, wherein the second tying member is formed from a thermoplastic material which is polyester.

23. The geosynthetic material according to claim 1, herein the first tying member and the second tying member are adjacent portions of a single tying member.

24. The geosynthetic material according to claim 1, herein the second tying member fixedly connects from 2 to 10 adjacent generally parallel spaced fiber strands selected from the first plurality of fiber strands.

25. The geosynthetic material according to claim 1, wherein the bonding agent comprises a thermoplastic material.

26. The geosynthetic material according to claim 1, wherein the bonding agent and the tying member fixedly connect a fiber strand of the first plurality of fiber strands with an intersecting fiber strand of the second plurality of fiber strands in the region of an intersection thereof.

27. The geosynthetic material according to claim 1, wherein the maximum strain along an axis parallel to the first plurality of fiber strands ranges from about 2% to about 4% at rupture of all of the first plurality of fiber strands under a tensile load applied along said axis.

28. A geosynthetic material for reinforcing a soil material to form a reinforced soil composite, the geosynthetic material comprising:

(a) a first plurality of spaced-apart generally parallel glass fiber strands;

(b) a second plurality of spaced-apart generally parallel glass fiber strands positioned adjacent to and forming a plurality of intersections with at least a portion of the first plurality of strands;

(c) a polyester tying member fixedly connecting portions of fiber strands of the first plurality of fiber strands with intersecting corresponding portions of the second plurality of fiber and fixedly connecting from about 2 to 10 adjacent generally parallel spaced fiber strands of the first plurality of fiber strands; and (d) a bonding agent comprising polyvinyl chloride adhering predetermined regions of selected fiber strands of the first plurality of fiber strands with predetermined regions of selected fiber strands of the second plurality of fiber strands;

wherein at least a portion of the fiber strands selected the group consisting of the first plurality of fiber strands, the second plurality of fiber strands and combinations thereof comprise glass fibers.

29. A geosynthetic composite comprising:

(a) first geosynthetic material comprising:

(i) a first plurality of spaced-apart generally parallel fiber strands;

(ii) a second plurality of spaced-apart generally parallel fiber strands positioned adjacent to and forming a plurality of intersections with at least a portion of the first plurality of strands;

(iii) a first tying member fixedly connecting portions of fiber strands of the first plurality of fiber strands with intersecting corresponding portions of the second plurality of fiber;

(iv) a second tying member fixedly connecting at least two adjacent generally parallel spaced fiber strands of the first plurality of fiber strands; and (v) a bonding agent adhering predetermined regions of selected fiber strands of the first plurality of fiber strands with predetermined regions of selected fiber strands of the second plurality of fiber strands;

wherein at least a portion of the fiber strands selected from the group consisting of the first plurality of fiber strands, the second plurality of fiber strands and combinations thereof comprise glass fibers; and (b) a second geosynthetic material coextensive with at least a portion of and positioned adjacent to at least one side of the first geosynthetic material, wherein the second geosynthetic material is different from the first geosynthetic material.

30. The reinforced soil composite of claim 29, wherein the composite is moisture permeable.

31. The reinforced soil composite of claim 29, wherein the composite is impermeable to moisture.

32. The geosynthetic composite according to claim 29, wherein the second geosynthetic material is selected from the group consisting of a geosynthetic clay liner, a film, a foil, and a fabric.

33. A geosynthetic material for reinforcing a soil material to form a reinforced soil composite, the geosynthetic material comprising:

(a) a first plurality of spaced-apart generally parallel fiber strands;

(b) a second plurality of spaced-apart generally parallel fiber strands positioned adjacent to and forming a plurality of intersections with at least a portion of the first plurality of strands;

(c) a tying member fixedly connecting portions of fiber strands of the first plurality of fiber strands with intersecting corresponding portions of the second plurality of fiber; and (d) a bonding agent adhering predetermined regions of selected fiber strands of the first plurality of fiber strands with predetermined regions of selected fiber strands of the second plurality of fiber strands;

wherein at least a portion of the fiber strands selected from the group consisting of the first plurality of fiber strands, the second plurality of fiber strands and combinations thereof comprise glass fibers.

34. A geosynthetic material for reinforcing a soil material to form a reinforced soil composite, the geosynthetic material comprising:

(a) a first plurality of spaced-apart generally parallel fiber strands;

(b) a second plurality of spaced-apart generally parallel fiber strands positioned interwoven with at least a portion of the first plurality of strands; and (c) a bonding agent adhering predetermined regions of selected fiber strands of the first plurality of fiber strands with predetermined regions of selected fiber strands of the second plurality of fiber strands;

wherein at least a portion of the fiber strands selected from the group consisting of the first plurality of fiber strands, the second plurality of fiber strands and combinations thereof comprise glass fibers.

35. The geosynthetic material according to claim 1, wherein the base coating composition is aqueous-based and the film-forming materials are selected from the group consisting acrylic polymers, polyamides, polyolefins, polyesters, polyurethanes, vinyl polymers and mixtures thereof.

36. A geosynthetic material for reinforcing a soil material to form a reinforced soil composite, the geosynthetic material comprising:

(a) a first plurality of spaced-apart generally parallel glass fiber strands, wherein the first plurality of glass fiber strands includes fibers coated with an essentially dried residue of a sizing composition and an aqueous based base coating composition comprising at least one acrylic polymer applied over the sizing composition such that at least a portion of the first plurality of fiber strands are impregnated with the base coating composition;

(b) a second plurality of spaced-apart generally parallel glass fiber strands positioned adjacent to and forming a plurality of intersections with at least a portion of the first plurality of strands, wherein the second plurality of glass fiber strands includes fibers coated with an essentially dried residue of the sizing composition and the aqueous based base coating composition comprising the at least one acrylic polymer applied over the sizing composition such that at least a portion of the first plurality of fiber strands are impregnated with the base coating composition;

(c) a first tying member fixedly connecting portions of fiber strands of the first plurality of fiber strands with intersecting corresponding portions of the second plurality of fiber strands;

(d) a second tying member fixedly connecting at least two adjacent generally parallel spaced fiber strands of the first plurality of fiber strands; and (e) a bonding agent adhering predetermined regions of selected fiber strands of the first plurality of fiber strands with predetermined regions of selected fiber strands of the second plurality of fiber strands, wherein the bonding agent is applied over selected portions of the base coating composition, wherein the geosynthetic material resists chemical and biological attack from soil material.

37. The geosynthetic material according to claim 36, wherein the fiber strands of the first plurality of fiber strands are generally coplanar, and the fiber strands of the second plurality of fiber strands are generally coplanar.

38. The geosynthetic material according to claim 36, wherein spacing between adjacent fiber strands of at least one portion of the fiber strands of the first plurality of fiber strands is different from spacing between adjacent strands of another portion of the fiber strands of the first plurality of fiber strands, and spacing between adjacent fiber strands of at least one portion of the fiber strands of the second plurality of fiber strands is different from spacing between adjacent strands of another portion of the fiber strands of the second plurality of fiber strands.

39. The geosynthetic material according to claim 36, wherein at least a portion of the fiber strands of the first plurality of fiber strands and a portion of the fiber strands of the second plurality of fiber strands are interwoven.

40. The geosynthetic material according to claim 36, wherein the fiber strands of the first plurality of fiber strands and the fiber strands of the second plurality of fiber strands are not interwoven.

41. The geosynthetic material according to claim 36, wherein the first tying member and the second tying member are each formed from a material selected from the group consisting of inorganic materials, natural materials, thermoplastic materials, thermosetting materials and combinations thereof.

42. The geosynthetic material according to claim 36, wherein the first tying member and the second tying member are adjacent portions of a single tying member.

43. The geosynthetic material according to claim 36, wherein the second tying member fixedly connects from 2 to 10 adjacent generally parallel spaced fiber strands selected from the first plurality of fiber strands.

44. The geosynthetic material according to claim 36, wherein the bonding agent comprises a thermoplastic material.

45. The geosynthetic material according to claim 36, wherein the bonding agent and the tying member fixedly connect a fiber strand of the first plurality of fiber strands with an intersecting fiber strand of the second plurality of fiber strands in the region of an intersection thereof.

46. The geosynthetic material according to claim 36, wherein the maximum strain along an axis parallel to the first plurality of fiber strands ranges from about 2% to about 4% at rupture of all of the first plurality of fiber strands under a tensile load applied along said axis.

* * * * *